US011008963B2

(12) United States Patent
Dudar et al.

(10) Patent No.: US 11,008,963 B2
(45) Date of Patent: May 18, 2021

(54) SYSTEMS AND METHODS FOR CONTROLLING PURGE FLOW FROM A VEHICLE FUEL VAPOR STORAGE CANISTER

(71) Applicant: Ford Global Technologies, LLC, Dearborn, MI (US)

(72) Inventors: Aed M. Dudar, Canton, MI (US); Scott Alan Bohr, Novi, MI (US); Matthew Werner, Kenockee Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 9 days.

(21) Appl. No.: 16/566,822

(22) Filed: Sep. 10, 2019

(65) Prior Publication Data

US 2021/0071599 A1 Mar. 11, 2021

(51) Int. Cl.
*F02D 41/00* (2006.01)
*F02D 41/12* (2006.01)

(52) U.S. Cl.
CPC ..... *F02D 41/004* (2013.01); *F02D 41/0037* (2013.01); *F02D 41/123* (2013.01)

(58) Field of Classification Search
CPC ..... F02D 41/004; F02D 41/0037
USPC ..... 123/520
See application file for complete search history.

(56) References Cited

U.S. PATENT DOCUMENTS 4,311,123 A * 1/1982 Glockler ..... F02D 41/126 123/325
4,677,956 A * 7/1987 Hamburg ..... F02M 25/08 123/520
5,271,368 A * 12/1993 Fujii ..... F02D 41/123 123/493
5,386,812 A * 2/1995 Curran ..... F02M 25/0809 123/520
5,666,934 A * 9/1997 Maki ..... F02D 41/008 123/679
6,334,835 B1 * 1/2002 Tanaka ..... F02D 41/126 477/187
7,812,467 B1 10/2010 Lemancik et al.
9,624,876 B2 4/2017 Pursifull
9,975,619 B1 * 5/2018 Gonring ..... B63H 21/14
(Continued)

FOREIGN PATENT DOCUMENTS

JP 04353254 A * 12/1992

OTHER PUBLICATIONS

"The alternator," PICO Technology Website, Available Online at https://www.picoauto.com/library/training/the-alternator, Available as Early as Jun. 13, 2017, 3 pages.

*Primary Examiner* — Mahmoud Gimie
*Assistant Examiner* — Joshua Campbell
(74) *Attorney, Agent, or Firm* — Geoffrey Brumbaugh; McCoy Russell LLP

(57) ABSTRACT

Methods and systems are provided for improving efficiency of purging a fuel vapor storage canister included in an evaporative emissions control system of a vehicle. In one example, a method includes controlling a duty cycle of a canister purge valve to purge fuel vapors stored in a fuel vapor storage canister to an engine of the vehicle, and adjusting a flow rate at which the fuel vapors are purged to the engine independently of the duty cycle by controlling a magnitude of a voltage supplied to the canister purge valve during the purging.

20 Claims, 9 Drawing Sheets

(56) References Cited

U.S. PATENT DOCUMENTS

| | | | | |
|---|---|---|---|---|
| 2003/0050150 | A1* | 3/2003 | Tanaka | B60H 1/14 477/62 |
| 2005/0194788 | A1* | 9/2005 | Kanai | F02D 41/003 290/40 B |
| 2008/0178837 | A1* | 7/2008 | Saitou | F16H 61/143 123/332 |
| 2012/0324929 | A1* | 12/2012 | Motegi | B60H 1/00764 62/133 |
| 2014/0123962 | A1* | 5/2014 | Ide | F02M 25/0836 123/520 |
| 2016/0069303 | A1* | 3/2016 | Pursifull | F02D 41/0032 701/103 |
| 2016/0312718 | A1* | 10/2016 | Dudar | F02D 41/003 |
| 2017/0129329 | A1* | 5/2017 | Tochihara | B60K 15/03504 |
| 2017/0198671 | A1* | 7/2017 | Dudar | F02M 35/10019 |
| 2017/0226939 | A1* | 8/2017 | Akita | B01D 53/0415 |
| 2017/0260918 | A1* | 9/2017 | Dudar | F02M 25/0854 |
| 2018/0058384 | A1* | 3/2018 | Dudar | F02D 41/0032 |

* cited by examiner

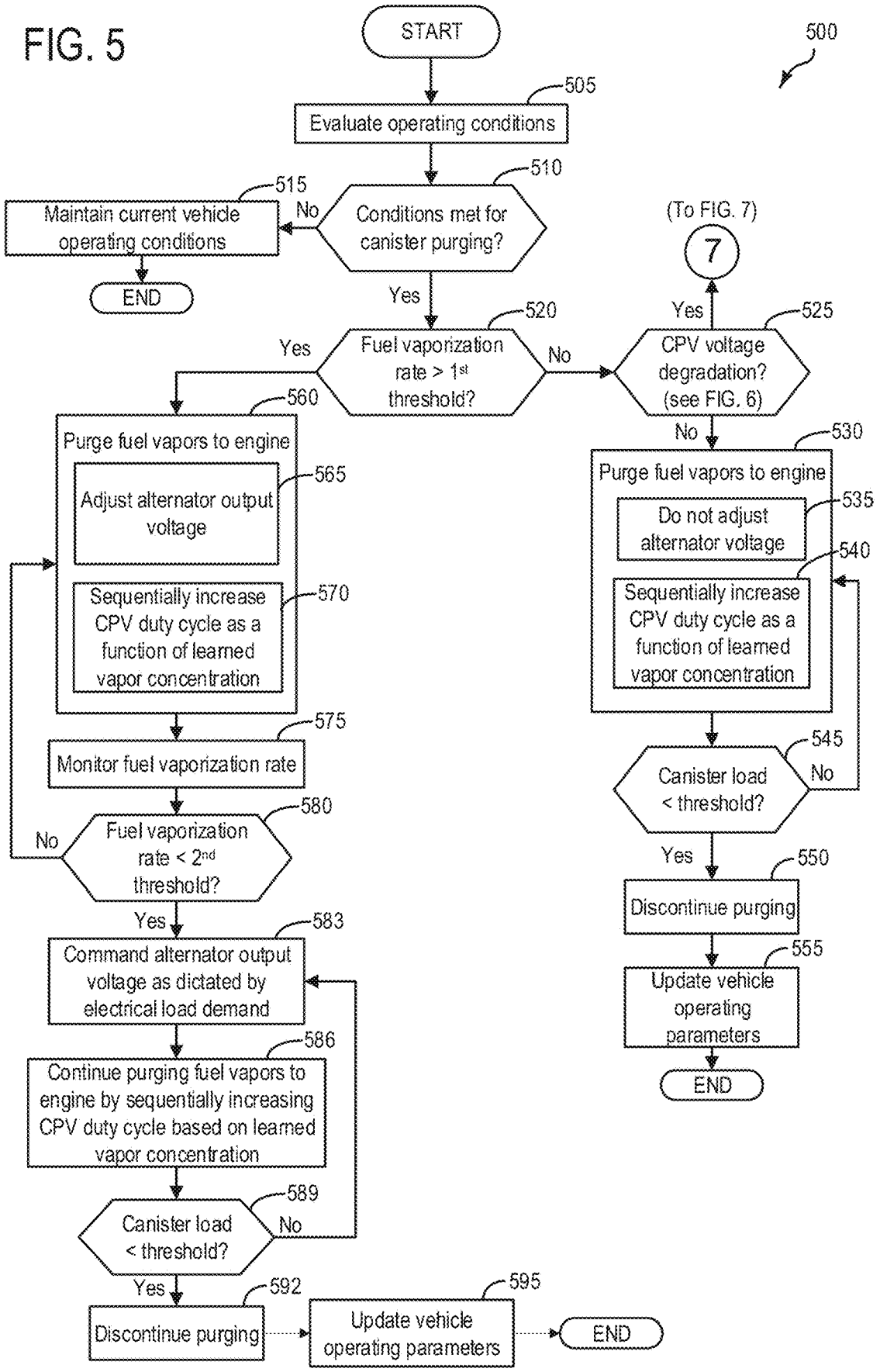
FIG. 5
500
START
505
Evaluate operating conditions
510
Conditions met for canister purging?
No
515
Maintain current vehicle operating conditions
END
Yes
520
Fuel vaporization rate > 1st threshold?
Yes
No
525
CPV voltage degradation? (see FIG. 6)
Yes
(To FIG. 7)
7
No
530
Purge fuel vapors to engine
535
Do not adjust alternator voltage
540
Sequentially increase CPV duty cycle as a function of learned vapor concentration
545
Canister load < threshold?
No
Yes
550
Discontinue purging
555
Update vehicle operating parameters
END
560
Purge fuel vapors to engine
565
Adjust alternator output voltage
570
Sequentially increase CPV duty cycle as a function of learned vapor concentration
575
Monitor fuel vaporization rate
580
Fuel vaporization rate < 2nd threshold?
No
Yes
583
Command alternator output voltage as dictated by electrical load demand
586
Continue purging fuel vapors to engine by sequentially increasing CPV duty cycle based on learned vapor concentration
589
Canister load < threshold?
No
Yes
592
Discontinue purging
595
Update vehicle operating parameters
END

SYSTEMS AND METHODS FOR CONTROLLING PURGE FLOW FROM A VEHICLE FUEL VAPOR STORAGE CANISTER

FIELD

The present description relates generally to methods and systems for selectively increasing a flow rate at which a fuel vapor storage canister is purged by controlling an output of a smart alternator.

BACKGROUND/SUMMARY

Vehicle evaporative emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical fuel vapor canister purge operation, a canister purge valve (CPV) coupled between the engine intake and the fuel canister is duty cycled, allowing for intake manifold vacuum to be applied to the fuel canister. Simultaneously, a canister vent valve (CVV) coupled between the fuel canister and atmosphere is opened, allowing for fresh air to enter the canister. This configuration facilitates desorption of stored fuel vapors from the adsorbent material in the fuel vapor canister, regenerating the adsorbent material for further fuel vapor adsorption.

However, changes to engine technology have introduced challenges to purging the canister. As an example, for fuel economy improvements engines may be mapped to have less intake manifold vacuum due to intake manifold vacuum being a pumping loss. As another example, cylinder deactivation technology can reduce intake manifold vacuum due to the deactivated cylinder(s) being sealed (e.g. intake and exhaust valves closed). In the above-mentioned examples, the reduction in intake manifold vacuum may result in inefficient canister purging.

Other issues related to canister purging efficiency include the fact that hybrid electric vehicles may spend a significant amount of operational time with the engine off, where canister purging cannot be conducted. In other words, limited engine-run time may reduce opportunities for canister purging operations to be conducted. Thus, it is imperative that canister purging operations be carried out in a manner as efficient as possible when conditions are met for purging, so that the canister is effectively cleaned so as to reduce opportunity for bleed emissions.

In this regard, certain operating conditions may impact the ability to effectively purge the canister in response to conditions being met for doing so. As one example, there may be drive cycles where a rate at which fuel is vaporizing and loading a canister is faster than a rate at which the canister is being purged, thereby leading to inefficient purging. As another example, electrical resistance in a wire that supplies a canister purge valve with voltage for duty cycling the canister purge valve may increase over time, thus resulting in a greater voltage drop across the wire, thereby degrading purge flow rate.

The inventors have herein recognized the above-mentioned issues, and have developed systems and methods to at least partially address them. In one example, a method comprises controlling a duty cycle of a canister purge valve to purge fuel vapors stored in a fuel vapor storage canister to an engine of a vehicle, and adjusting a flow rate at which the fuel vapors are purged to the engine independently of the duty cycle by controlling a magnitude of a voltage supplied to the canister purge valve during the purging. In this way, the flow rate at which fuel vapors are purged to the engine may be controlled in a manner that improves purging efficiency as a function of operational conditions of the vehicle.

As one example, adjusting the flow rate may include increasing the flow rate by increasing the magnitude of the voltage supplied to the canister purge valve, and decreasing the flow rate by decreasing the magnitude of the voltage supplied to the canister purge valve. Adjusting the flow rate may include adjusting an output voltage of a smart alternator, for example.

As one example, the method may include adjusting the flow rate in response to an indication that there is a degraded voltage supply to the canister purge valve. An indication that the voltage supply to the canister purge valve is degraded may be based on a determination of a voltage drop across an electrical connection between an onboard energy storage device and the canister purge valve, as compared to a baseline voltage drop across the same electrical connection.

As yet another example, the method may include adjusting the flow rate in response to an indication of a fuel tank pressure greater than a threshold fuel tank pressure during the purging. Additionally or alternatively, the method may include adjusting the flow rate in response to an indication that fuel vapors are escaping from the canister to atmosphere immediately prior to or during the purging. Such an indication may be provided via output from a hydrocarbon sensor positioned in a vent line stemming from the canister and/or based on a temperature increase of the canister at a position near the vent line, as monitored via a canister temperature sensor.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 5 depicts an example method for controlling a voltage supplied to a canister purge valve during a canister purging event where a fuel vaporization rate is greater than a threshold rate;

DETAILED DESCRIPTION

Figure 2:
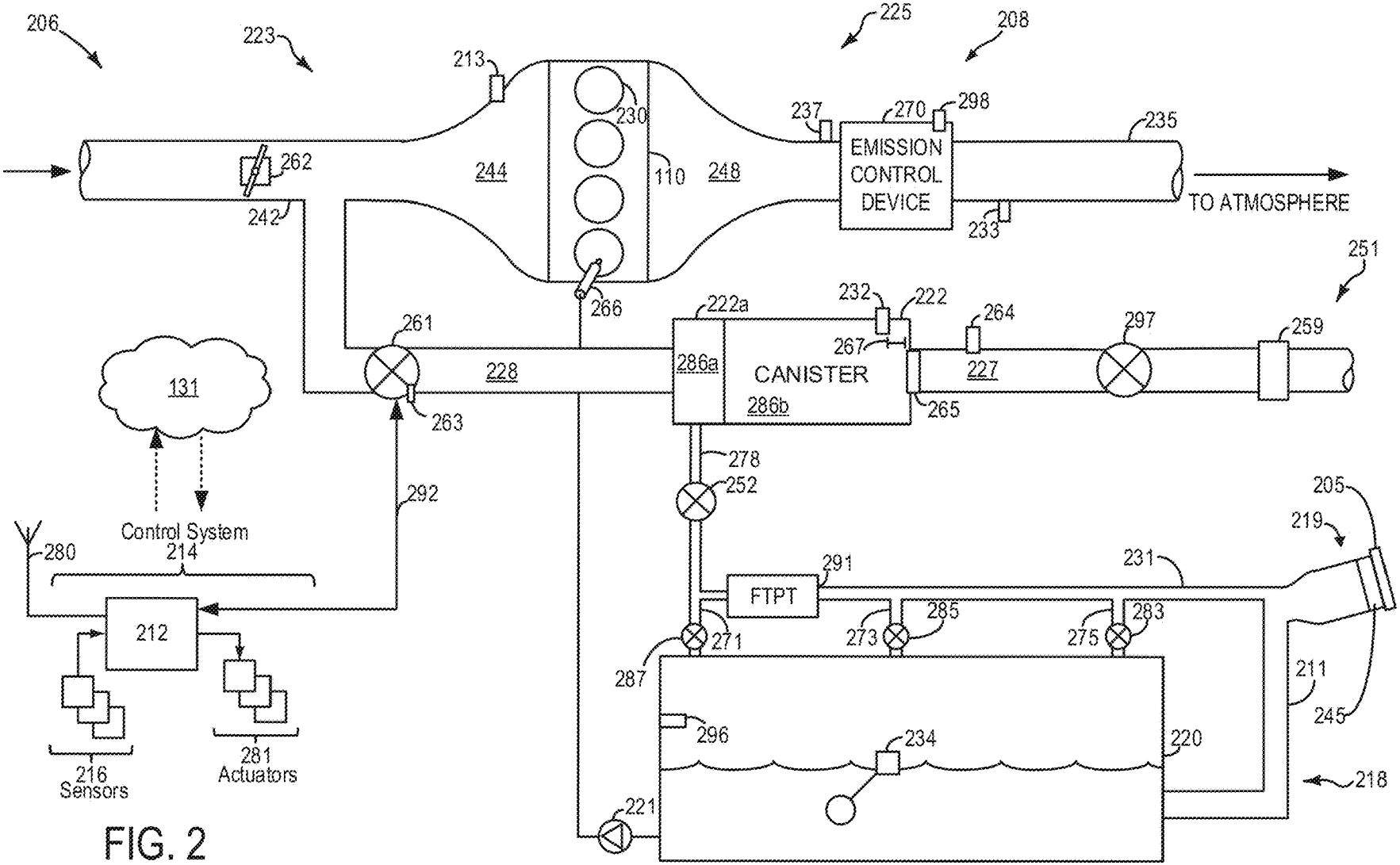
FIG. 2 schematically shows an example vehicle system with a fuel system and an evaporative emissions system.
Figure 3A:
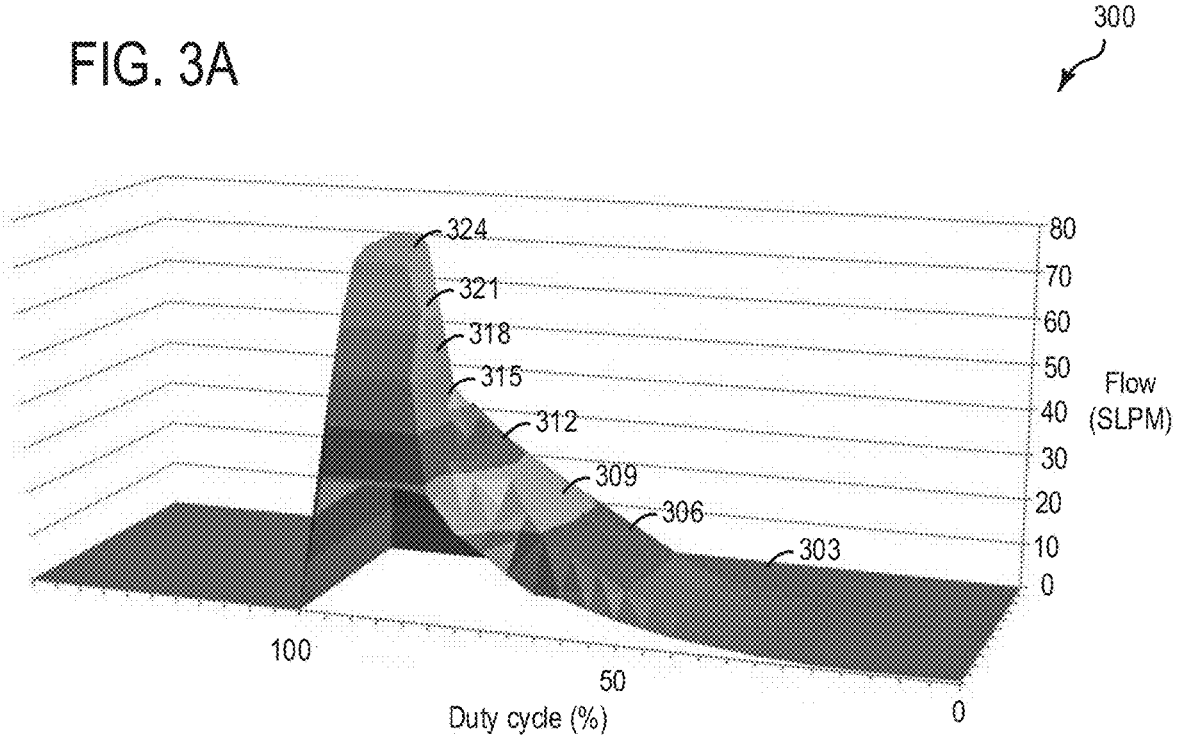
FIG. 3A depicts a purge flow rate as a function of canister purge valve duty cycle at an alternator output of 10 volts.
Figure 3B:
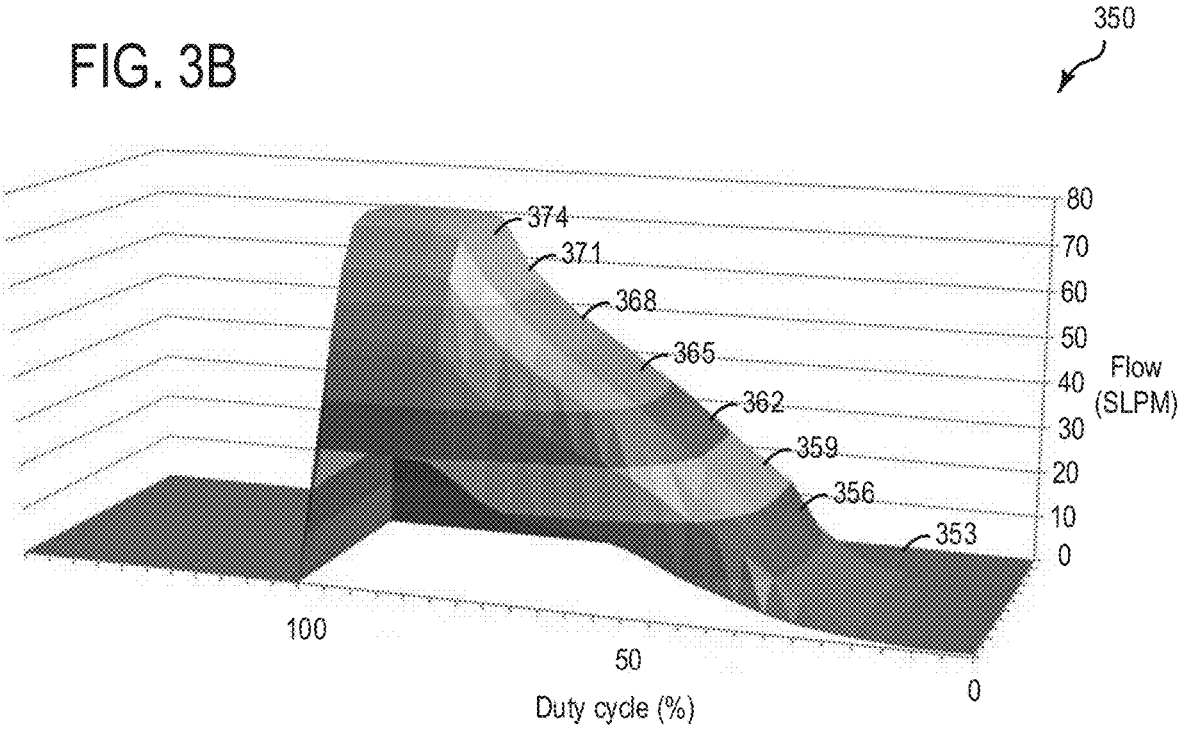
FIG. 3B depicts a purge flow rate as a function of canister purge valve duty cycle at an alternator output of 15 volts.
Figure 4:
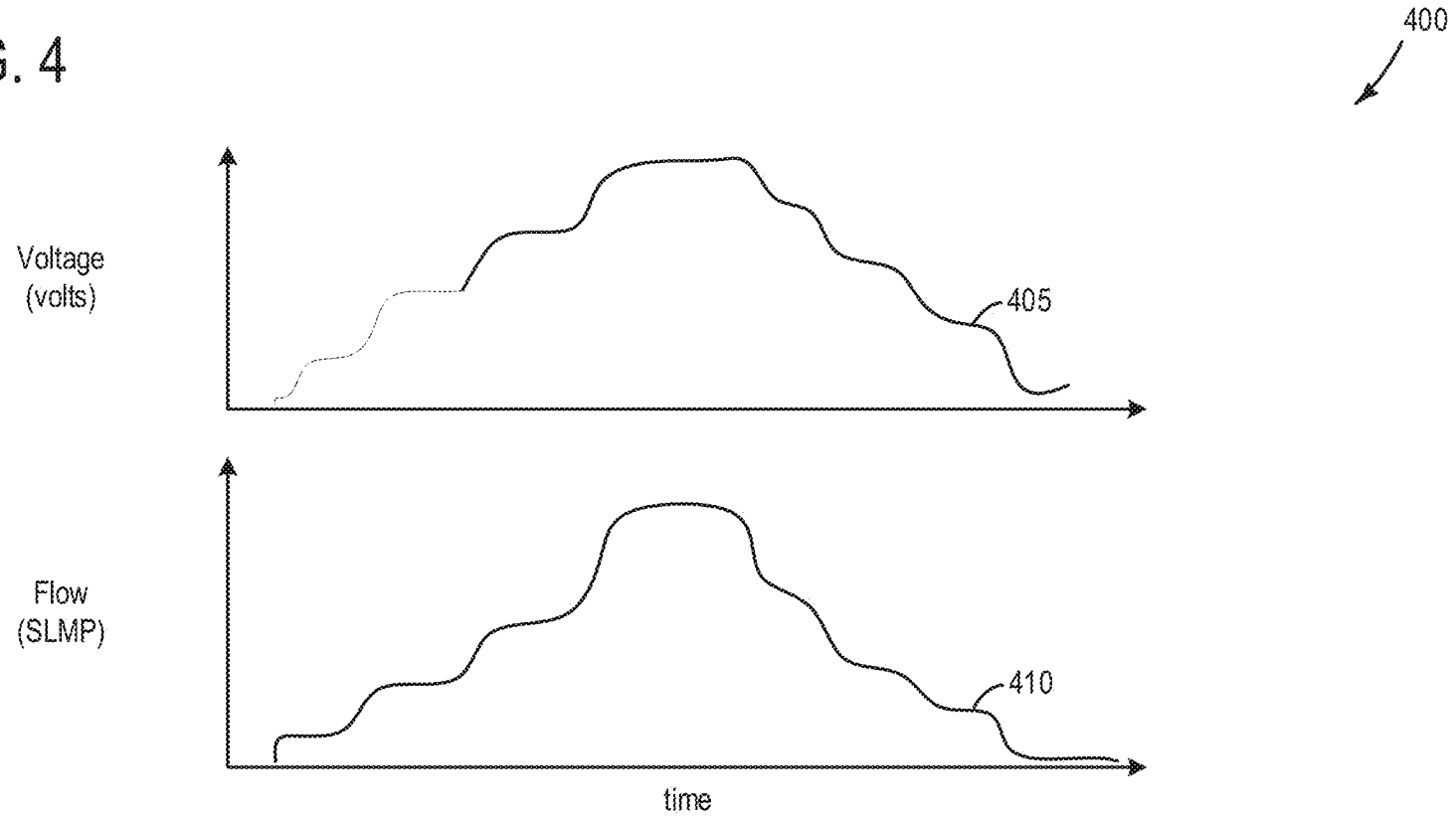
FIG. 4 depicts an example of how voltage supplied to a canister purge valve impacts purge flow rate.
Figure 6:
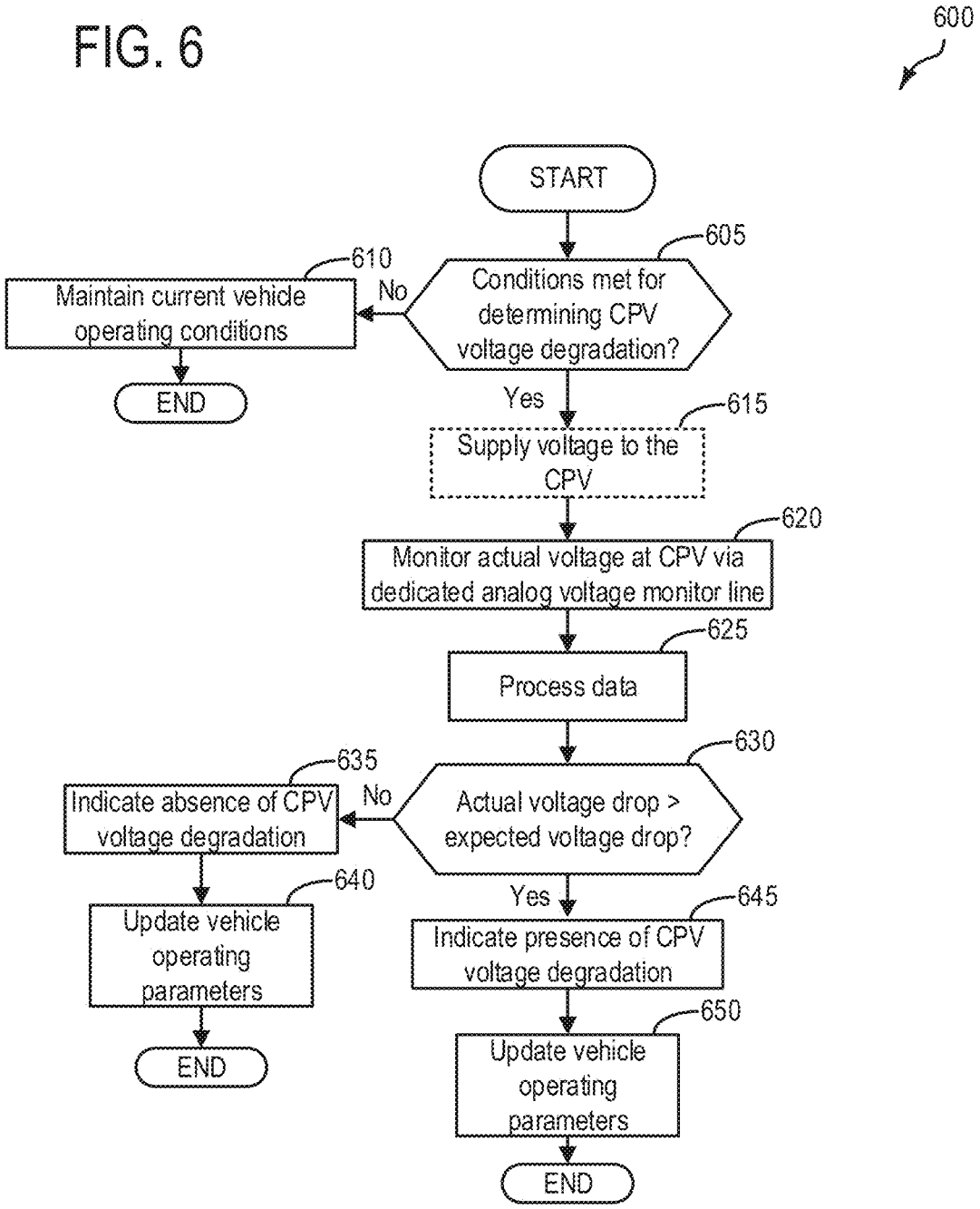
FIG. 6 depicts an example method for determining whether there is degraded voltage supply to the canister purge valve.
Figure 8:
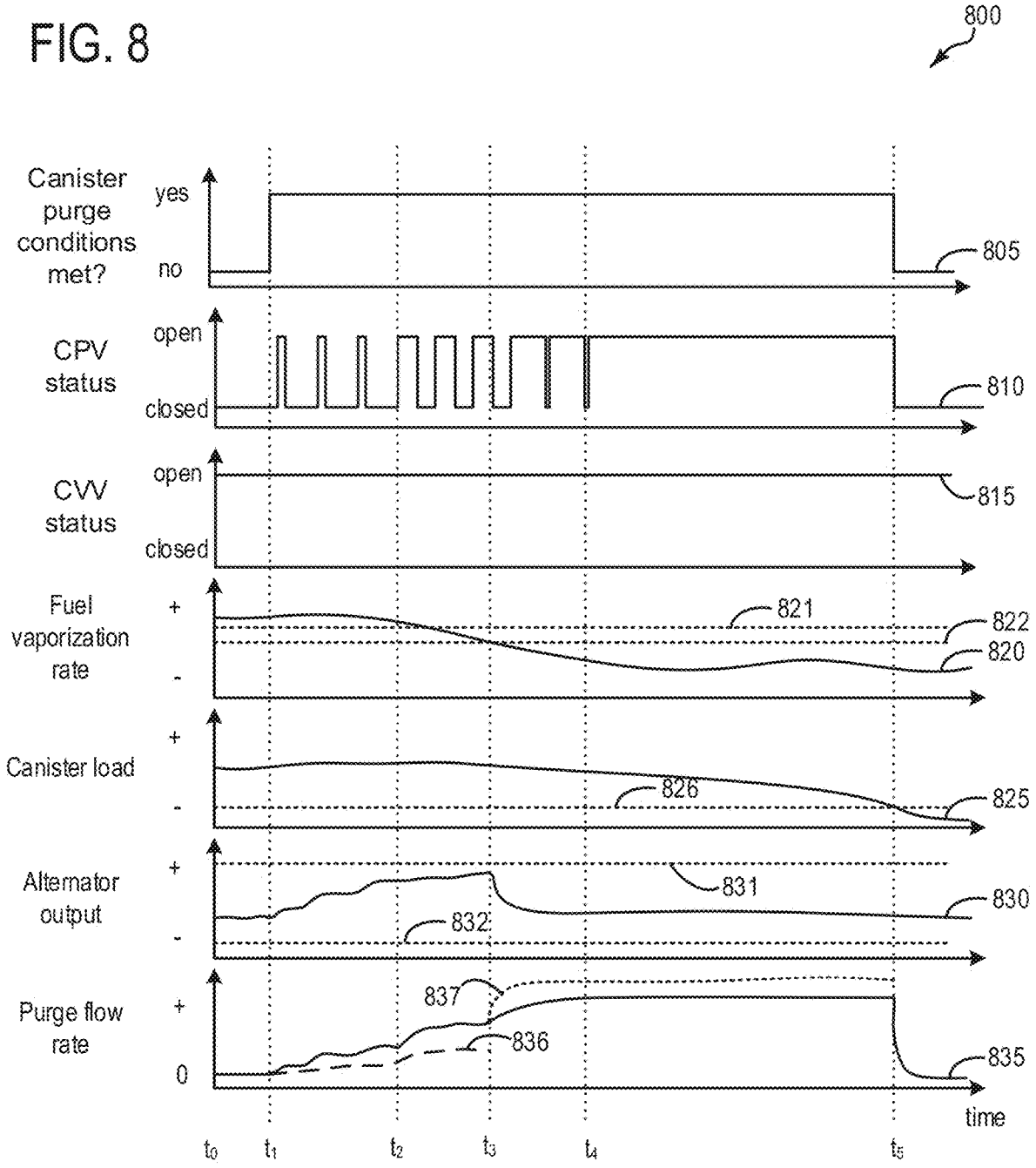
FIG. 8 depicts a prophetic example for controlling a voltage supplied to a canister purge valve during a canister purging event according to the method of FIG. 5.
Figure 9:
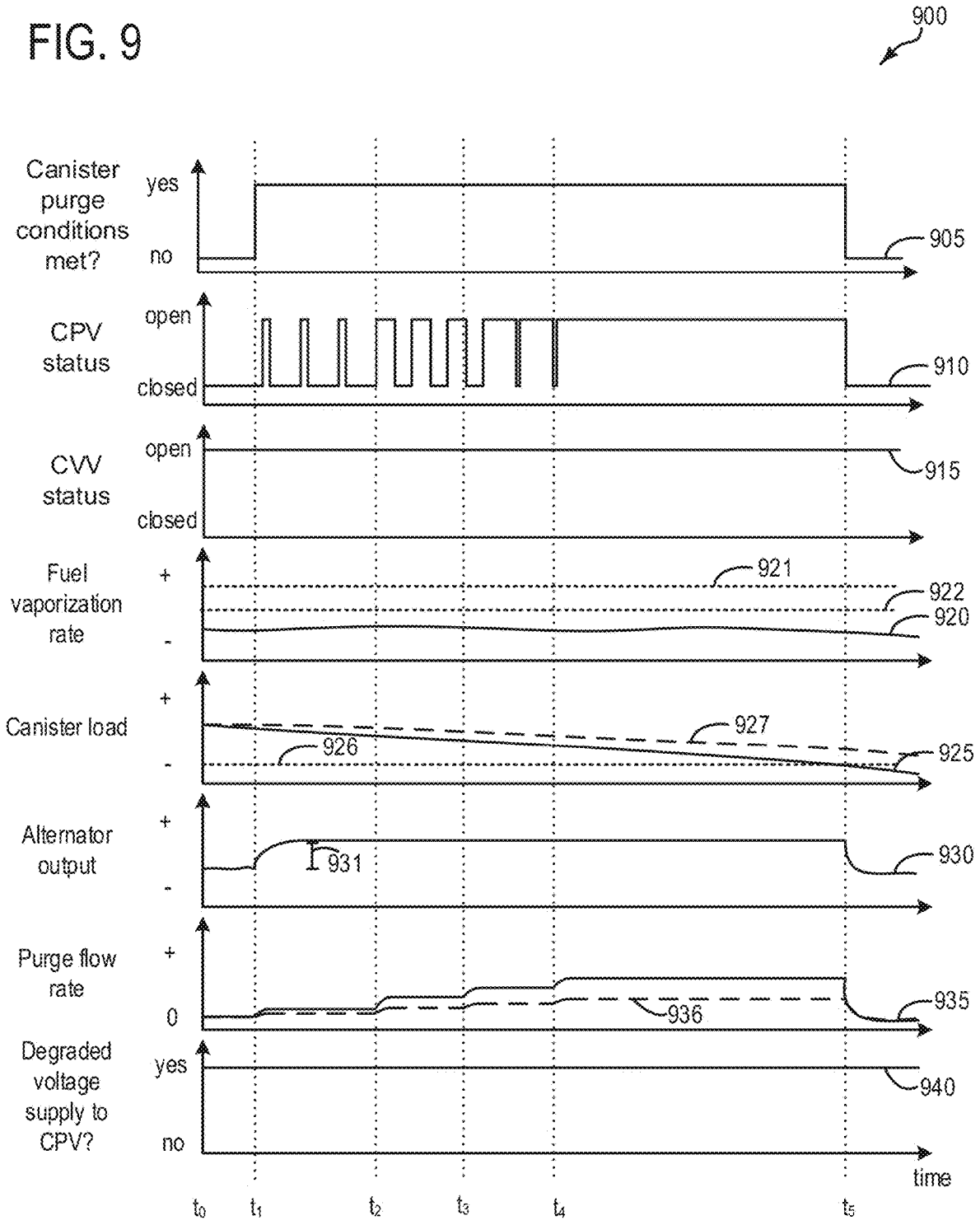
FIG. 9 depicts an example method for controlling a voltage supplied to the canister purge valve during a canister purging event according to the method of FIG. 7.

The following description relates to systems and methods for increasing effectiveness of purging of a fuel vapor storage canister. The methods may be applicable to hybrid electric vehicle propulsion systems, such as the propulsion system depicted at FIG. 1. The propulsion system may include a smart alternator, which can vary its output voltage under control of a vehicle controller, such as the controller depicted at FIG. 1. FIG. 2 depicts an engine system coupled to an evaporative emissions system and a fuel system, where fuel vapors stemming from the fuel tank are adsorbed by a fuel vapor canister positioned in the evaporative emissions system, prior to being desorbed to engine intake for combustion. As mentioned above, certain operating conditions (e.g. fuel vaporization greater than a threshold vaporization rate, degraded voltage supply to a canister purge valve solenoid) may degrade the ability of intake manifold vacuum to purge the canister effectively. To increase a purge flow rate under such circumstances, output from the smart alternator may be commanded to a greater value, so that a greater voltage may be supplied to the canister purge valve solenoid. To illustrate the point, FIG. 3A depicts a purge flow rate as a function of canister purge valve duty cycle when 10 volts are supplied to the canister purge valve solenoid, and FIG. 3B depicts a purge flow rate as a function of canister purge valve duty cycle when 15 volts are supplied to the canister purge valve solenoid. Along similar lines, FIG. 4 depicts a data set showing how increasing voltage supplied to the canister purge valve correspondingly results in a greater purge flow rate, for a particular canister purge valve duty cycle. Thus, FIGS. 3A-4 illustrate how it may be possible to increase purge flow rate without changing (e.g. increasing) canister purge valve duty cycle, by increasing a voltage supplied to the canister purge valve solenoid via a smart alternator. It may be advantageous to do control a purge event in such a way under conditions where canister purging is degraded (e.g. fuel vaporization greater than a threshold vaporization rate or degraded voltage supply to a canister purge valve solenoid). Accordingly, FIG. 5 depicts a method for controlling a voltage supply to a canister purge valve solenoid for purging the canister under circumstances where the fuel vaporization rate is greater than the threshold rate. Alternatively, FIG. 6 depicts a method for determining whether there is a degraded voltage supply to the canister purge valve solenoid. If such degraded voltage supply to the canister purge valve solenoid is determined, then the method of FIG. 7 may be used to increase purge flow by increasing voltage supplied to the canister purge valve solenoid via the smart alternator. FIG. 8 depicts a prophetic example for how canister purging may be conducted according to the method of FIG. 5, and FIG. 9 depicts a prophetic example for how canister purging may be conducted according to the method of FIG. 7.

Figure 1:
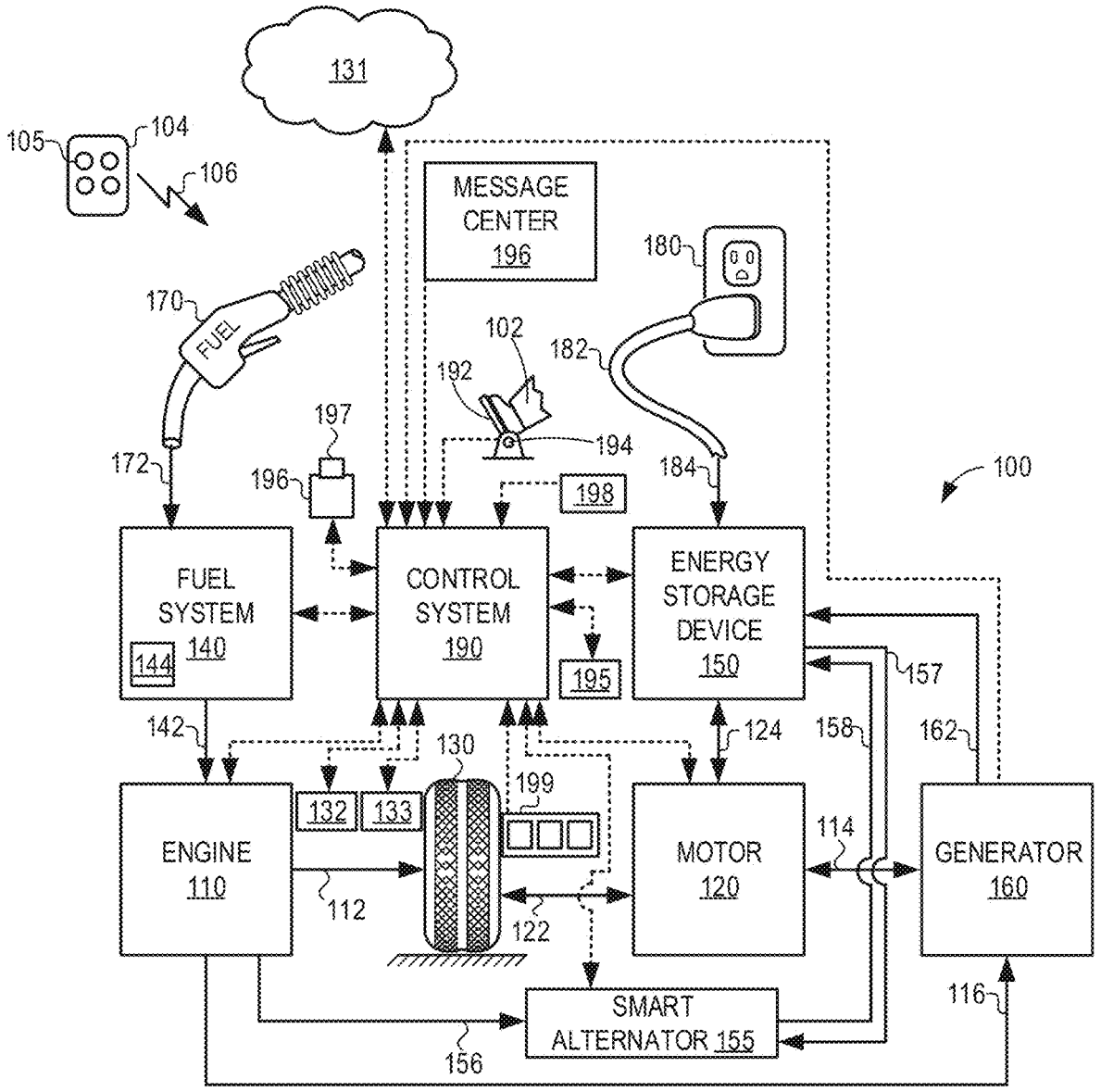
FIG. 1 schematically shows an example vehicle propulsion system.

Turning now to the figures, FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Engine 110 may additionally drive smart alternator 155, as indicated by arrow 156. Smart alternator 155 may have a control voltage sensing input line 157 stemming from energy storage device 150, which may provide a set point for alternator output as is known in the art based on an electrical load requested from the battery. Alternator output may in some examples be a function of a temperature of energy storage device 150. Electrical energy generated by smart alternator 155 may be routed to energy storage device 150, as depicted by arrow 158. As discussed in further detail, smart alternator may in some examples be controlled via control system 190 to increase its output in response to conditions being met for doing so. For example, there may be certain conditions where it is desirable to increase alternator output voltage during a canister purging event so as to direct a higher voltage to a canister purge valve solenoid, which may in turn increase purge flow through the canister purge valve as will be elaborated in further detail below.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, smart alternator 155, and generator 160. Control system 190 may receive sensory feedback information from one or more of engine 110, motor 120, fuel system 140, energy storage device 150, smart alternator 155, and generator 160. Further, control system 190 may send control signals to one or more of engine 110, motor 120, fuel system 140, energy storage device 150, smart alternator 155, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone, or smartphone based system where a user's cellular telephone sends data to a server and the server communicates with the vehicle to start the engine.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor (not shown at FIG. 1 but see FIG. 2). The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, or inertial sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

Control system 190 may be communicatively coupled to other vehicles or infrastructures using appropriate communications technology, as is known in the art. For example, control system 190 may be coupled to other vehicles or infrastructures via a wireless network 131, which may comprise Wi-Fi, Bluetooth, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V212V), and/or vehicle-to-infrastructure (V2I or V2X) technology. The communication and the information exchanged between vehicles can be either direct between vehicles, or can be multi-hop. In some examples, longer range communications (e.g. WiMax) may be used in place of, or in conjunction with, V2V, or V212V, to extend the coverage area by a few miles. In still other examples, vehicle control system 190 may be communicatively coupled to other vehicles or infrastructures via a wireless network 131 and the internet (e.g. cloud), as is commonly known in the art.

Vehicle system 100 may also include an on-board navigation system 132 (for example, a Global Positioning System) that an operator of the vehicle may interact with. The navigation system 132 may include one or more location sensors for assisting in estimating vehicle speed, vehicle altitude, vehicle position/location, etc. This information may be used to infer engine operating parameters, such as local barometric pressure. As discussed above, control system 190 may further be configured to receive information via the internet or other communication networks. Information received from the GPS may be cross-referenced to information available via the internet to determine local weather conditions, local vehicle regulations, etc. In some examples, vehicle system 100 may include lasers, radar, sonar, acoustic sensors 133, which may enable vehicle location, traffic information, etc., to be collected via the vehicle.

FIG. 2 shows a schematic depiction of a vehicle system 206. It may be understood that vehicle system 206 may comprise the same vehicle system as vehicle system 100 depicted at FIG. 1. The vehicle system 206 includes an engine system 208 coupled to an emissions control system (evaporative emissions system) 251 and a fuel system 218. It may be understood that fuel system 218 may comprise the same fuel system as fuel system 140 depicted at FIG. 1. Emission control system 251 includes a fuel vapor container or canister 222 which may be used to capture and store fuel vapors. In some examples, vehicle system 206 may be a hybrid electric vehicle system. However, it may be understood that the description herein may refer to a non-hybrid vehicle, for example a vehicle equipped with an engine and not an motor that can operate to at least partially propel the vehicle, without departing from the scope of the present disclosure.

The engine system 208 may include an engine 110 having a plurality of cylinders 230. The engine 110 includes an engine air intake 223 and an engine exhaust 225. The engine air intake 223 includes a throttle 262 in fluidic communication with engine intake manifold 244 via an intake passage 242. Further, engine air intake 223 may include an air box and filter (not shown) positioned upstream of throttle 262. The engine exhaust system 225 includes an exhaust manifold 248 leading to an exhaust passage 235 that routes exhaust gas to the atmosphere. The engine exhaust system 225 may include one or more exhaust catalyst 270, which may be mounted in a close-coupled position in the exhaust. In some examples, an electric heater 298 may be coupled to the exhaust catalyst, and utilized to heat the exhaust catalyst to or beyond a predetermined temperature (e.g. light-off temperature). One or more emission control devices may include a three-way catalyst, lean NOx trap, diesel particulate filter, oxidation catalyst, etc. It will be appreciated that other components may be included in the engine such as a variety of valves and sensors. For example, a barometric pressure sensor 213 may be included in the engine intake. In one example, barometric pressure sensor 213 may be a manifold air pressure (MAP) sensor and may be coupled to the engine intake downstream of throttle 262. Barometric pressure sensor 213 may rely on part throttle or full or wide open throttle conditions, e.g., when an opening amount of throttle 262 is greater than a threshold, in order accurately determine BP.

Fuel system 218 may include a fuel tank 220 coupled to a fuel pump system 221. It may be understood that fuel tank 220 may comprise the same fuel tank as fuel tank 144 depicted above at FIG. 1. In some examples, the fuel system may include a fuel tank temperature sensor 296 for measuring or inferring a fuel temperature. The fuel pump system 221 may include one or more pumps for pressurizing fuel delivered to the injectors of engine 110, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system (referred to herein as evaporative emissions system) 251 which includes a fuel vapor canister 222 via vapor recovery line 231, before being purged to the engine air intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be positioned in conduits 271, 273, or 275. Among other functions, fuel tank vent valves may allow the fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283.

Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some examples, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some examples, refueling lock 245 may be a filler pipe valve located at a mouth of fuel filler pipe 211. In such examples, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some examples, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In examples where refueling lock 245 is locked using an electrical mechanism, refueling lock 245 may be unlocked by commands from controller 212, for example, when a fuel tank pressure decreases below a pressure threshold. In examples where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222, as discussed. The fuel vapor canisters may be filled with an appropriate adsorbent 286*b*, such that the canisters are configured to temporarily trap fuel vapors (including vaporized hydrocarbons) during fuel tank refilling operations and during diagnostic routines, as will be discussed in detail below. In one example, the adsorbent 286*b* used is activated charcoal. Emissions control system 251 may further include a canister ventilation path or vent line 227 which may route gases out of the canister 222 to the atmosphere when storing, or trapping, fuel vapors from fuel system 218.

Canister 222 may include buffer 222*a* (or buffer region), each of the canister and the buffer comprising the adsorbent. As shown, the volume of buffer 222*a* may be smaller than (e.g., a fraction of) the volume of canister 222. The adsorbent 286*a* in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and canister load may be estimated based on temperature changes within the canister. In some examples, a canister temperature sensor 232 may be positioned within a threshold distance 267 of a vent port 265 of the canister. Such a canister temperature sensor may be used to indicate circumstances where fuel vapors may be escaping from the fuel vapor storage canister to atmosphere. For example, a canister temperature increase as monitored via the canister temperature sensor 232 positioned within the threshold distance 267 of the vent port 265 may be indicative of fuel vapors bleeding through canister 222 to atmosphere.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve (CVV) 297 coupled within vent line 227. When included, the canister vent valve 297 may be a normally open valve. In some examples, a vapor bypass valve (VBV) 252 may be positioned between the fuel tank and the fuel vapor canister 222 within conduit 278. However, in other examples VBV 252 may not be included without departing from the scope of this disclosure. Where included, VBV 252 may include a notch opening or orifice, such that even when closed, the fuel tank may be allowed to vent pressure through said notch opening or orifice. A size of the notch opening or orifice may be calibratable. In one example, the notch opening or orifice may comprise a diameter of 0.09", for example. During regular engine operation, VBV 252 may be kept closed to limit the amount of diurnal or "running loss" vapors directed to canister 222 from fuel tank 220. During refueling operations, and selected purging conditions, VBV 252 may be temporarily opened, e.g., for a duration, to direct fuel vapors from the fuel tank 220 to canister 222. While the depicted example shows VBV 252 positioned along conduit 278, in alternate embodiments, the VBV may be mounted on fuel tank 220. Due to the notch opening or orifice associated with VBV 252, fuel vapors stemming from the fuel tank may continue to load canister 222 under conditions where a fuel vaporization rate is high (e.g. greater than a threshold fuel vaporization rate).

Thus, fuel system 218 may be operated by controller 212 in a plurality of modes by selective adjustment of the various valves and solenoids. It may be understood that control system 214 may comprise the same control system as control system 190 depicted above at FIG. 1. For example, the fuel system may be operated in a fuel vapor storage mode (e.g., during a fuel tank refueling operation and with the engine not combusting air and fuel), wherein the controller 212 may command VBV 252 (where included) to an open configuration while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may command VBV 252 (where included) to the open configuration while maintaining canister purge valve 261 closed, to depressurize the fuel tank before allowing enabling fuel to be added therein. As such, VBV 252 (where included) may be maintained in the open configuration during the refueling operation to allow refueling vapors to be stored in the canister. After refueling is completed, the VBV (where included) may be commanded closed.

As yet another example, the fuel system may be operated in a canister purging mode (e.g., after an emission control device light-off temperature has been attained and with the engine combusting air and fuel), wherein the controller 212 may open or duty cycle CPV 261 while commanding VBV 252 (where included) to a closed configuration and commanding CVV 297 open. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold. In some examples, purging may include additionally commanding VBV 252 (where included) to the open position such that fuel vapors from the fuel tank may additionally be drawn into the engine for combustion. It may be understood that such purging of the canister may further include commanding or maintaining open CVV 297.

In some examples, CVV 297 may be a solenoid valve wherein opening or closing of the valve is performed via actuation of a canister vent solenoid. In particular, the canister vent valve may be a normally open valve that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVV closed may be reduced.

Similarly, CPV 261 may be a solenoid valve wherein opening or closing of the CPV is performed via actuation of a canister purge valve solenoid 263. The CPV may be a normally closed valve that is opened upon actuation of the canister purge valve solenoid. In some examples, a voltage monitor line 292 may communicatively couple the CPV (and canister purge valve solenoid) to controller 212. The voltage monitor line 292 may be an analog voltage monitor line, for example. The voltage monitor line 292 may be used to quantify an inherent voltage drop across the wiring and connection from the electrical energy source (e.g. energy storage device 150) to the canister purge valve solenoid, in order to infer whether there is a degraded voltage supply to CPV 261. For example, a baseline voltage drop across the wiring and connection to the CPV may be determined under conditions where the wiring and connection is new or just installed, and then may periodically retrieve additional information pertaining to the voltage drop as time goes by during the life cycle of the vehicle. By comparing the voltage drop at periodic time points to the baseline voltage drop, controller 212 may infer whether there is a degraded voltage supply to the canister purge valve solenoid for actuating the CPV.

Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device 270, temperature sensor 233, pressure sensor 291, canister temperature sensor 232 and hydrocarbon sensor 264. The hydrocarbon sensor 264 may be used to infer breakthrough of hydrocarbons from canister 222, for example. Other sensors such as pressure, temperature, air/fuel ratio, and composition sensors may be coupled to various locations in the vehicle system 206. As another example, the actuators may include throttle 262, VBV 252 (where included), canister purge valve 261 (e.g. canister purge valve solenoid 263), and canister vent valve 297 (canister vent valve solenoid, not shown). Controller 212 may receive input data from the various sensors, process the input data, and trigger the actuators in response to the processed input data based on instruction or code programmed therein corresponding to one or more routines. Example control routines are described herein with regard to FIGS. 5-7.

Undesired evaporative emissions detection routines may be intermittently performed by controller 212 on fuel system 218 and/or evaporative emissions system 251 to confirm that undesired evaporative emissions are not present in the fuel system and/or evaporative emissions system. One example test diagnostic for undesired evaporative emissions includes application of engine manifold vacuum on the fuel system and/or evaporative emissions system that is otherwise sealed from atmosphere, and in response to a threshold vacuum being reached, sealing the evaporative emissions system from the engine and monitoring pressure bleed-up in the evaporative emissions system to ascertain a presence or absence of undesired evaporative emissions In some examples, engine manifold vacuum may be applied to the fuel system and/or evaporative emissions system while the engine is combusting air and fuel. In other examples, the engine may be commanded to be rotated unfueled in a forward direction (e.g. the same direction the engine rotates when combusting air and fuel) to impart a vacuum on the fuel system and/or evaporative emissions system. In still other examples, a pump (not shown) positioned in vent line 227 may be relied upon for applying a vacuum on the fuel system and/or evaporative emissions system.

Controller 212 may further include wireless communication device 280, to enable wireless communication between the vehicle and other vehicles or infrastructures, via wireless network 131.

Turning now to FIGS. 3A-3B, they depict example data sets showing how increased voltage supplied to a CPV, or more specifically, to a canister purge valve solenoid (e.g. canister purge valve solenoid 263), may increase a flow rate at which a fluid flow (e.g. air and/or fuel vapor) is drawn through the CPV en route to engine intake. Beginning with FIG. 3A, an example 3D plot 300 depicts flow rate (standard liter per minute, or SLPM) as a function of duty cycle when the voltage supplied to the CPV is 10 volts. Section 303 depicts flow rate between 0-10 SLPM, section 306 depicts flow rate between 10-20 SLPM, section 309 depicts flow rate between 20-30 SLPM, section 312 depicts flow rate between 30-40 SLPM, section 315 depicts flow rate between 40-50 SLPM, section 318 depicts flow rate between 50-60 SLPM, section 321 depicts flow rate between 60-70 SLPM, and section 324 depicts flow rate between 70-80 SLPM. Flow rate clearly increases as a function of duty cycle as can be seen at FIG. 3A.

FIG. 3B depicts another example 3D plot 350 illustrating flow rate as a function of duty cycle, but where the voltage supplied to the CPV is 15 volts. Section 353 depicts flow rate between 0-10 SLPM, section 356 depicts flow rate between 10-20 SLPM, section 359 depicts flow rate between 20-30 SLPM, section 362 depicts flow rate between 30-40 SLPM, section 365 depicts flow rate between 40-50 SLPM, section 368 depicts flow rate between 50-60 SLPM, section 371 depicts flow rate between 60-70 SLPM, and section 374 depicts flow rate between 70-80 SLPM. Based on a comparison of the data between that of FIG. 3A and that of FIG. 3B, it may be understood that increasing voltage to the CPV results in an increased flow rate as a function of CPV duty cycle. As an illustrative example, supplying the CPV with 10 volts under conditions where a CPV duty cycle is 50% results in a flow rate between 0-10 SLPM as depicted at FIG. 3A. Alternatively, when the CPV is supplied with 15 volts at the same 50% CPV duty cycle, the flow rate is clearly increased as illustrated at FIG. 3B, as compared to that of FIG. 3A.

Turning now to FIG. 4, another example illustration 400 is shown, depicting how stepwise increases in voltage supplied to a CPV, or more specifically, to a canister purge valve solenoid may result in increased purge flow rate for a given duty cycle. Accordingly, FIG. 4 includes plot 405, indicating voltage supplied to the CPV, over time, and plot 410, indicating purge flow rate (SLPM), over time. The duty cycle of the CPV corresponding to plots 405 and 410 remains fixed at 5% duty cycle. Clearly, increasing the voltage supply to the CPV results in greater purge flow rate at the given CPV duty cycle, whereas decreasing the voltage supply to the CPV results in a lesser purge flow rate at the given CPV duty cycle. Thus, it may be understood that increasing or decreasing the voltage supplied to the CPV may increase or decrease purge flow rate, respectively, independent of CPV duty cycle.

Thus, discussed herein, a system for a vehicle may include a fuel vapor storage canister that receives fuel vapors from a fuel tank, a canister purge valve for purging fuel vapors stored at the fuel vapor storage canister to an engine, and a smart alternator that charges an onboard energy storage device. The system may further include a controller with computer readable instructions stored on non-transitory memory. When executed, the instructions may cause the controller to raise an output voltage of the smart alternator during a canister purging event in response to an indication that fuel vaporization rate of fuel in the fuel tank is greater than a first threshold fuel vaporization rate during the canister purging event.

For such a system, the system may further include a fuel tank pressure transducer. In such an example, the controller may store further instructions to indicate that the fuel vaporization rate of fuel in the fuel tank is greater than the first threshold fuel vaporization rate under conditions where a fuel tank pressure as monitored via the fuel tank pressure transducer is greater than a non-zero positive pressure threshold with respect to atmospheric pressure during and/or immediately prior to the canister purging event.

For such a system, the system may further include a hydrocarbon sensor positioned in a vent line that couples the fuel vapor storage canister to atmosphere. In such an example, the controller may store further instructions to indicate that the fuel vaporization rate of fuel in the fuel tank is greater than the first threshold fuel vaporization rate in response to an indication that fuel vapors are migrating into the vent line as monitored via the hydrocarbon sensor, immediately prior to and/or during the canister purging event.

For such a system, the system may further include a canister temperature sensor positioned in the fuel vapor storage canister, within a threshold distance of a vent port of the fuel vapor storage canister. In such an example, the controller may store further instructions to indicate that the fuel vaporization rate of fuel in the fuel tank is greater than the first threshold fuel vaporization rate in response to an increase in canister temperature as monitored via the canister temperature sensor immediately prior to and/or during the canister purging event.

For such a system, the controller may store further instructions to reduce the output voltage of the smart alternator during the canister purging event in response to an indication that the fuel vaporization rate has been reduced from being greater than the first threshold fuel vaporization rate to less than a second threshold fuel vaporization rate, where the second threshold fuel vaporization rate is equal to or less than the first threshold fuel vaporization rate.

For such a system, the system may further include an exhaust gas oxygen sensor. In such an example, the controller may store further instructions to learn a concentration of fuel vapors being inducted to the engine during the canister purging event based at least in part on output from the exhaust gas oxygen sensor. The controller may store further instructions to sequentially increase a duty cycle of the canister purge valve as a function of the learned concentration of fuel vapors being inducted to the engine, where raising the output voltage of the smart alternator is in addition to sequentially increasing the duty cycle of the canister purge valve.

Turning now to FIG. 5, an example method 500 is depicted, illustrating how a canister purging event may be conducted depending on whether a fuel vaporization rate is greater than a first threshold fuel vaporization rate, and whether there is some indication of degraded voltage supply to the CPV (e.g. CPV 261 at FIG. 2). Specifically, in response to an indication of a fuel vaporization rate being greater than the first threshold fuel vaporization rate during a canister purging event, an alternator output voltage may be increased under control of a controller (e.g. controller 212 at FIG. 2), so as to increase purge flow which may serve to reduce the fuel vaporization rate to below a second threshold fuel vaporization rate, where the second threshold fuel vaporization rate is equal to or lower than the first threshold fuel vaporization rate.

Method 500 will be described with reference to the systems described herein and shown in FIGS. 1-2, though it will be appreciated that similar methods may be applied to other systems without departing from the scope of this disclosure. Instructions for carrying out method 500 may be executed by a controller, such as controller 212 of FIG. 2, based on instructions stored in non-transitory memory, and in conjunction with signals received from sensors of the engine system, such as temperature sensors, pressure sensors, and other sensors described in FIGS. 1-2. The controller may employ actuators such as throttle CPV (e.g. CPV 261 at FIG. 2), CVV (e.g. CVV 297 at FIG. 2), smart alternator (e.g. smart alternator 155 at FIG. 1), etc., to alter states of devices in the physical world according to the methods depicted below. Method 500 will be discussed below under an assumption that the vehicle does not include a VBV (e.g. VBV 252 at FIG. 2). However, it may be understood that method 500 may still equally apply to vehicles that include a VBV without departing from the scope of this disclosure.

Method 500 begins at 505 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 510, method 500 includes indicating whether conditions are met for purging the canister (e.g.

canister 222 at FIG. 2). Conditions being met may include an engine-on condition, where the engine is combusting air and fuel. Additionally or alternatively, conditions being met at 510 may include an indication that a loading state of the canister is greater than a first threshold canister loading state. The first threshold canister loading state may be a loading state greater than 40% saturated with fuel vapors, greater than 50% saturated, greater than 60% saturated, etc. Additionally or alternatively, conditions being met at 510 may include an indication of an intake manifold vacuum greater than a threshold intake manifold vacuum. The intake manifold vacuum may be monitored via a pressure sensor (e.g. sensor 213 at FIG. 2) positioned in the intake manifold, for example. The threshold intake manifold vacuum may comprise a non-zero negative pressure with respect to atmospheric pressure that is expected to be able to effectively purge the canister of fuel vapors stored therein, for example. Additionally or alternatively, conditions being met at 510 may include an indication that engine stability may not be compromised due to purging fuel vapors from the canister to the engine for combustion. Additionally or alternatively, conditions being met at 510 may include an indication that fuel vapors are about to or are already escaping from the canister into the vent line (e.g. vent line 227 at FIG. 2). Such an indication may be provided via the hydrocarbon sensor (e.g. hydrocarbon sensor 264 at FIG. 2) positioned in the vent line, and/or based on an output from one or more temperature sensor(s) (e.g. temperature sensor 232 at FIG. 2) included in the canister.

If, at 510, conditions are not indicated to be met for purging the canister, then method 500 may proceed to 515. At 515, method 500 includes maintaining current vehicle operating conditions. For example, current vehicle operating conditions may be maintained without commanding the CPV duty cycled to initiate the process of purging the canister. Method 500 may then end. While method 500 is depicted as engine, it may be understood that in some examples method 500 may return to the start of method 500, so as to continually query whether conditions are met for canister purging.

Returning to 510, responsive to conditions being met for purging the canister, method 500 proceeds to 520. At 520, method 500 includes indicating whether fuel vaporization rate is greater than the first threshold fuel vaporization rate. Fuel vaporization rate greater than the first threshold rate may be determined in one example based on a fuel tank pressure as monitored via the FTPT (e.g. FTPT 291 at FIG. 2). For example, a fuel tank pressure greater than a threshold fuel tank pressure may be indicative of the fuel vaporization rate being greater than the first threshold fuel vaporization rate. As another example, fuel vaporization rate greater than the first threshold fuel vaporization rate may be indicated based on output from a canister temperature sensor (e.g. sensor 232 at FIG. 2) positioned near the vent line (e.g. vent line 227 at FIG. 2). For example, if the canister temperature sensor is responding (e.g. indicating an increased temperature) to the presence of fuel vapors, then it may be inferred that fuel vapors are escaping into the vent line, which may be indicative of fuel vaporization being greater than the first threshold fuel vaporization rate. As another example, fuel vaporization rate greater than the first threshold fuel vaporization rate may be inferred based on output from a hydrocarbon sensor positioned in the vent line. For example, if the hydrocarbon sensor is responding to the presence of hydrocarbons in the vent line, then it may be inferred that fuel vapors are escaping from the canister to the vent line, which may occur under conditions where the fuel vaporization rate is greater than the first threshold fuel vaporization rate.

If, at 520, the fuel vaporization rate is not greater than the first threshold fuel vaporization rate, then method 500 may proceed to 525. At 525, method 500 includes indicating whether there is an indication of degraded voltage supply to the CPV. The methodology for determining whether there is degraded voltage supply to the CPV is shown at FIG. 6.

Accordingly, turning now to FIG. 6, it depicts example methodology for inferring whether there is degraded voltage supply to the CPV, and if so, by how much the voltage supply is degraded. Method 600 will be described with reference to the systems described herein and shown in FIGS. 1-2, though it will be appreciated that similar methods may be applied to other systems without departing from the scope of this disclosure. Instructions for carrying out method 600 may be executed by a controller, such as controller 212 of FIG. 2, based on instructions stored in non-transitory memory, and in conjunction with signals received from sensors of the engine system such as temperature sensors, pressure sensors, and other sensors described in FIGS. 1-2. The controller may employ actuators to alter states of devices in the physical world according to the method depicted below.

Method 600 begins at 605, and includes indicating whether conditions are met for determining whether there is degraded voltage supply to the CPV. Conditions being met may include one or more of the following conditions. For example, conditions being met may include vehicle operating conditions where supplying voltage to the CPV may not adversely impact any ongoing vehicle control strategy. As one example, conditions being met at 605 may include an indication that a remote start of the vehicle has been requested. In such an example, where the engine is controlled to an engine idle speed, commanding open the CPV may result in fuel vapors being directed to engine intake due to their being desorbed from the canister, but because the vehicle is unoccupied any engine hesitation or stumble due to the increased fuel vapor concentration being consumed by the engine may go unnoticed so as to not be an NVH (noise, vibration and harshness) issue.

In another example, conditions being met may include an ongoing canister purging event. For example, the act of duty cycling the CPV for a purging event may include the controller sending voltage pulses to the CPV, and for each voltage pulse a corresponding voltage drop between the source of the electrical energy and the CPV may be determined.

In another example, conditions being met may include the vehicle operating in an electric-only mode of operation. Under circumstances where the vehicle is being propelled solely via electric power, then supplying a voltage to the CPV may result in the CPV opening, however because the engine is not in operation fuel vapors may not be purged to the engine, which may avoid any issues related to engine hesitation and/or stall when diagnosing degraded voltage supply to the CPV.

As another example, conditions being met at 605 may include an indication that a predetermined amount of time has elapsed since a prior diagnostic to determine degraded voltage supply to the CPV was conducted.

As another example, conditions being met at 605 may include an indication that the canister is not being cleaned as effectively as desired or expected. For example, in response to canister purging events taking longer than expected to reduce canister loading state to below a threshold canister loading state (e.g. 5% loaded or less), correcting for intake manifold vacuum level and initial loading state, then it may be inferred that there may be degraded voltage supply to the CPV.

If, at 605, it is inferred that conditions are not met for determining whether there is degraded voltage supply to the CPV, method 600 proceeds to 610. At 610, method 600 includes maintaining current vehicle operating conditions. Specifically, current vehicle operating conditions may be maintained without specifically providing a voltage to the CPV for purposes of diagnosing degraded voltage supply. Method 600 may then end. While method 600 is depicted as ending, it may be understood that in other examples method 600 may continually return to the start of method 600 in order to regularly judge as to whether conditions are met for determining degraded voltage supply to the CPV.

Returning to 605, in response to an indication that conditions for determining degraded voltage supply to the CPV are met, method 600 proceeds to 615. At 615, method 600 includes supplying voltage to the CPV. As one example, the voltage supplied may be a predetermined voltage (e.g. 12 volts). The voltage may be supplied as a single pulse of a predetermined duration in some examples. The voltage may be supplied as a plurality of pulses, each pulse of a predetermined duration, in another example. In some examples where the CPV is already being duty cycled, then it may be understood that voltage may already be being supplied to the CPV, and thus step 615 is depicted as a dashed box to illustrate that in some examples voltage may already be being supplied to the CPV.

Proceeding to 620, method 600 includes monitoring actual voltage at the CPV via the dedicated analog voltage monitor line (e.g. voltage monitor line 292 at FIG. 2). In other words, the voltage drop between the voltage commanded to the CPV and the actual voltage received at the CPV may be monitored. In an example where a single voltage pulse was provided to the CPV, then a single actual voltage that is recorded via the voltage monitor line may be stored at the controller. In other examples where a plurality of voltage pulses were provided to the CPV, then each of the plurality of actual values corresponding to each of the plurality of voltage pulses may be stored at the controller. The actual values may then be averaged in order to obtain a high confidence actual voltage, for example, and the average value may be stored at the controller.

Continuing to 625, method 600 includes processing the data regarding the actual voltage at the CPV. Specifically, as mentioned above, there may be a baseline voltage drop expected between the energy storage device and the CPV, under circumstances where there is no inferred voltage supply degradation (e.g. new wiring, newly installed CPV and associated components, etc.). The actual voltage (or averaged actual voltage) determined at 620 may be compared to the supplied voltage to infer an actual voltage drop. Specifically, the actual voltage may be subtracted from the commanded voltage, to determine the actual voltage drop. Then, at 630, the actual voltage drop may be compared via the controller to the baseline voltage drop. If the actual voltage drop differs from the baseline voltage drop by more than a threshold (e.g. differs by greater than 0.2 volts, greater than 0.5 volts, etc., then a degraded voltage supply to the CPV may be inferred. In other words, if the actual voltage drop is greater than the baseline voltage drop by more than a threshold, then degraded voltage supply to the CPV may be inferred.

Accordingly, responsive to the actual voltage drop not being greater than the baseline voltage drop by greater than a threshold, method 600 proceeds to 635. At 635, method 600 includes indicating an absence of degraded voltage supply to the CPV. In other words, the amount of voltage commanded to the CPV and the actual voltage at the CPV are within a predetermined tolerance range where degraded voltage supply is not inferred. Accordingly, at 640, method 600 includes updating vehicle operating parameters. Because a degraded voltage supply to the CPV is not indicated, updating vehicle operating parameters may include storing the passing result at the controller. No adjustments to canister purging schedule or instructions related to how to purge the canister may be made due to the absence of voltage supply degradation. Method 600 may then end.

Alternatively, returning to 630, responsive to an indication that the actual voltage drop is greater than the baseline voltage drop by more than the threshold, method 600 proceeds to 645. At 645, method 600 includes indicating the presence of degraded voltage supply to the CPV. The result may be stored at the controller. Proceeding to 650, method 600 includes updating vehicle operating parameters. Specifically, an appropriate diagnostic trouble code (DTC) may be set. In some examples, responsive to such a result, a malfunction indicator light (MIL) may be illuminated at the vehicle dash, alerting the vehicle operator of a request to have the vehicle serviced. Instructions pertaining to how to conduct canister purging operations may be updated and/or modified. For example, instructions may be updated to include that smart alternator output voltage may be increased by an amount corresponding to the actual voltage drop in order to supply a greater voltage to the CPV, which may thereby improve purge flow and as a result, canister purging efficiency. However, the amount by which the alternator output voltage is increased may be dependent on one or more other factors, including but not limited to battery state of charge (SOC), battery temperature, difference between the actual voltage drop and baseline voltage drop, nominal alternator output regulation limits, etc. Method 600 may then end.

Thus, returning to 525, in response to an indication of degraded voltage supply to the CPV, method 500 may proceed to method 700 depicted at FIG. 7, which will be discussed in greater detail below. Alternatively, in an example where fuel canister purging conditions are met (step 510) and where fuel vaporization rate is not greater than the first threshold fuel vaporization rate (step 520) and where degraded voltage supply to the CPV is not inferred (step 525), method 500 proceeds to 530.

At 530, method 500 includes purging fuel vapors stored in the canister to the engine for combustion. Briefly, because the fuel vaporization rate is less than the first threshold fuel vaporization rate and there is no indication of degraded voltage supply to the CPV, at 535 method 500 includes not adjusting the alternator output voltage. In other words, the alternator output voltage that the alternator is currently outputting to charge the battery may be maintained. The output voltage may be dependent on variables including but not limited to battery temperature, battery SOC, engine operating conditions such as engine load and engine speed, etc.

Continuing to 540, method 500 includes sequentially increasing CPV duty cycle as a function of learned fuel vapor concentration being inducted to the engine, as is known in the art. Briefly, the CPV may be commanded at first to a low duty cycle (e.g. 10%) so that an amount of fuel vapors initially inducted to the engine is low. This may avoid potential for engine hesitation and/or stall due to an unexpectedly rich air-fuel ratio as a result of the additional fuel vapors being inducted to the engine from the canister before the vapor concentration being inducted to the engine is learned. As the concentration is learned, the CPV duty cycle may be ramped up accordingly as a function of the learned concentration. More specifically, an exhaust gas sensor (e.g. exhaust gas sensor 237 at FIG. 2) may be relied upon for determining an exhaust air-fuel ratio, which may be used in conjunction with levels of fuel injection and air flow to the engine to ascertain an amount of vapors being inducted to the engine due to the purging operation. Accordingly, the fuel vapor concentration stemming from the canister may be learned during the purging operation, and the CPV duty cycle may be correspondingly sequentially increased in order to effectively purge the canister while also avoiding issues related to engine hesitation and/or stall. Furthermore, the learned vapor concentration may be relied upon via the controller of the vehicle for indicating a current canister loading state.

Thus, with the canister purging event in progress, method 500 proceeds to 545. At 545, method 500 includes indicating whether canister load is less than the threshold canister load (e.g. loaded to less than 5% with fuel vapors). As discussed, the learned concentration of fuel vapors being inducted to the engine may be used to infer canister loading state. For example, when the amount or concentration of fuel vapors being inducted to the engine is below a predetermined concentration and/or is not substantially changing (e.g. not changing by more than 1-2% for a predetermined time duration), then it may be inferred that canister loading state is below the threshold canister load. Thus, at 545, if canister load is not below the threshold canister load, method 500 returns to 530 where the canister is continued to be purged and the CPV duty cycle appropriately ramped up until the duty cycle achieves 100% (e.g. fully open without transitioning to the fully closed state).

Alternatively, responsive to the canister load dropping to below the threshold canister load, method 500 proceeds to 550. At 550, method 500 includes discontinuing the purging event. Discontinuing the purging event may include commanding fully closed the CPV, for example. Proceeding to 555, method 500 includes updating vehicle operating parameters. For example, canister loading state may be updated, and a canister purging schedule may be updated to reflect the recently conducted purge event of the canister. Method 500 may then end.

Returning to 520, in response to an indication that conditions are met for purging of the canister but where fuel vaporization rate is greater than the threshold fuel vaporization rate, method 500 proceeds to 560. At 560, method 500 includes purging fuel vapors stored at the canister to engine intake, however the purging operation is conducted in a different manner than that described for step 530. Specifically, at 565, method 500 includes adjusting the alternator output voltage. Specifically, because it is inferred that the fuel vaporization rate is greater than the threshold fuel vaporization rate, a greater purge flow may be desired so as to counter the fuel vaporization, to enable effective purging of the canister. It may be understood that it may not be possible to simply raise the duty cycle of the CPV to increase purge flow due to the onboard strategy clipping how much the CPV duty cycle can be increased based on learned fuel vapor concentration. Thus, increasing alternator output voltage so as to increase a voltage supplied to the CPV may provide a way in which to increase purge flow without modifying the strategy for ramping up the duty cycle of the CPV (refer to FIG. 4 for example).

Accordingly, at 565, method 500 includes adjusting alternator output voltage for the smart alternator (e.g. smart alternator 155 at FIG. 1). In one example, alternator output voltage may be adjusted as a function of the fuel vaporization rate. For example, alternator output voltage may be increased as fuel vaporization rate increases, where the greater the fuel vaporization rate, the greater the alternator output voltage (within a tolerance range). In other examples, alternator output voltage may be increased to a predetermined output voltage. In still other examples, the alternator output voltage may be ramped up as the canister purging event is taking place (e.g. while the CPV is being duty cycled and where the CPV duty cycle is sequentially increased over time). Accordingly, at 570, method 500 includes conducting the canister purging operation by sequentially increasing the CPV duty cycle over time as a function of learned fuel vapor concentration being inducted to the engine, similar to that discussed above with regard to step 530. However as discussed, the difference is that during such a process, alternator voltage output is increased in either a manner where the alternator output is ramped up over time, controlled to a predetermined voltage output, or controlled to a voltage output that is a function of the rate of fuel vaporization.

It may be understood that certain operating conditions may impact how the alternator output can be raised. For example, battery SOC, battery temperature, engine load, engine speed, alternator output tolerance range, etc., may be factored in to a determination as to how much (and in some examples a rate) alternator output may be changed.

With the purging event initiated and alternator output raised to increase purge flow so as to counter the effects of fuel vaporization, method 500 proceeds to 575. At 575, method 500 includes monitoring the fuel vaporization rate. The fuel vaporization rate may be monitored similar to that discussed above. It may be understood that the impetus for increasing purge flow is to reduce the fuel vaporization rate to a level where effective purging of the canister may occur. For example, when fuel vaporization is greater than the threshold fuel vaporization rate, the canister may be being loaded with fuel vapors at a rate faster than a rate at which the canister is being purged of fuel vapors. This may lead to inefficient purging and may lead to release of undesired evaporative emissions to atmosphere due to fuel vapor breakthrough from the canister into the vent line. By increasing the purge flow, the fuel vaporization may be reduced to below a second threshold fuel vaporization rate where fuel vapors are purged from the canister at a rate faster than that which fuel vapors are being routed to the canister from the fuel tank. It may be understood that the mechanism of reducing the fuel vaporization rate relates to an increase in negative pressure with respect to atmospheric pressure being directed at the fuel tank, thereby lowering the rate at which fuel is vaporizing.

Accordingly, at 580, method 500 includes indicating whether the fuel vaporization rate is less than the second threshold fuel vaporization rate. If not, then method 500 may return to 560, where purging of the canister may continue in the manner discussed, where CPV duty cycle is sequentially increased as a function of learned fuel vapor concentration being inducted to the engine and with alternator output voltage increased.

Alternatively, in response to the fuel vaporization rate being determined to be less than the second threshold fuel vaporization rate at 580, method 500 proceeds to 583. At 583, method 500 includes commanding alternator voltage output as dictated by electrical load demand. In other words, the alternator output voltage may be reduced because it is no longer requested to be raised as fuel vaporization rate is lower than the second threshold fuel vaporization rate. Maintaining the alternator output raised when there is not a need to do so may reduce fuel economy, and thus it may be desirable to minimize the fuel economy impact by lowering the alternator output voltage to a level dictated just by electrical load immediately following the indication that fuel vaporization has been controlled to below the second threshold fuel vaporization rate.

With the alternator output adjusted at 583, method 500 proceeds to 586. At 586, method 500 includes continuing to purge fuel vapors to engine intake via the process of sequentially increasing CPV duty cycle as a function of learned fuel vapor concentration being inducted to the engine. At 589, method 500 includes determining whether canister load is lower than the threshold canister load (e.g. loaded to less than 5% with fuel vapors), similar to that discussed above. If not, then method 500 may return to 583 where purging of the canister may continue as discussed. Alternatively, responsive to an indication that canister load is below the threshold canister load, method 500 proceeds to 592. At 592, method 500 includes discontinuing the canister purging operation by commanding closed the CPV. Proceeding to 595, method 500 includes updating vehicle operating parameters. Updating vehicle operating parameters may include updating the canister loading state to reflect the purging event. Updating vehicle operating parameters may additionally include updating a battery SOC, given that the alternator was operated at an output voltage different than that demanded solely via electrical load for at least a portion of the purging event. A canister purge schedule may be updated to reflect the purging event. Method 500 may then end.

Figure 7:
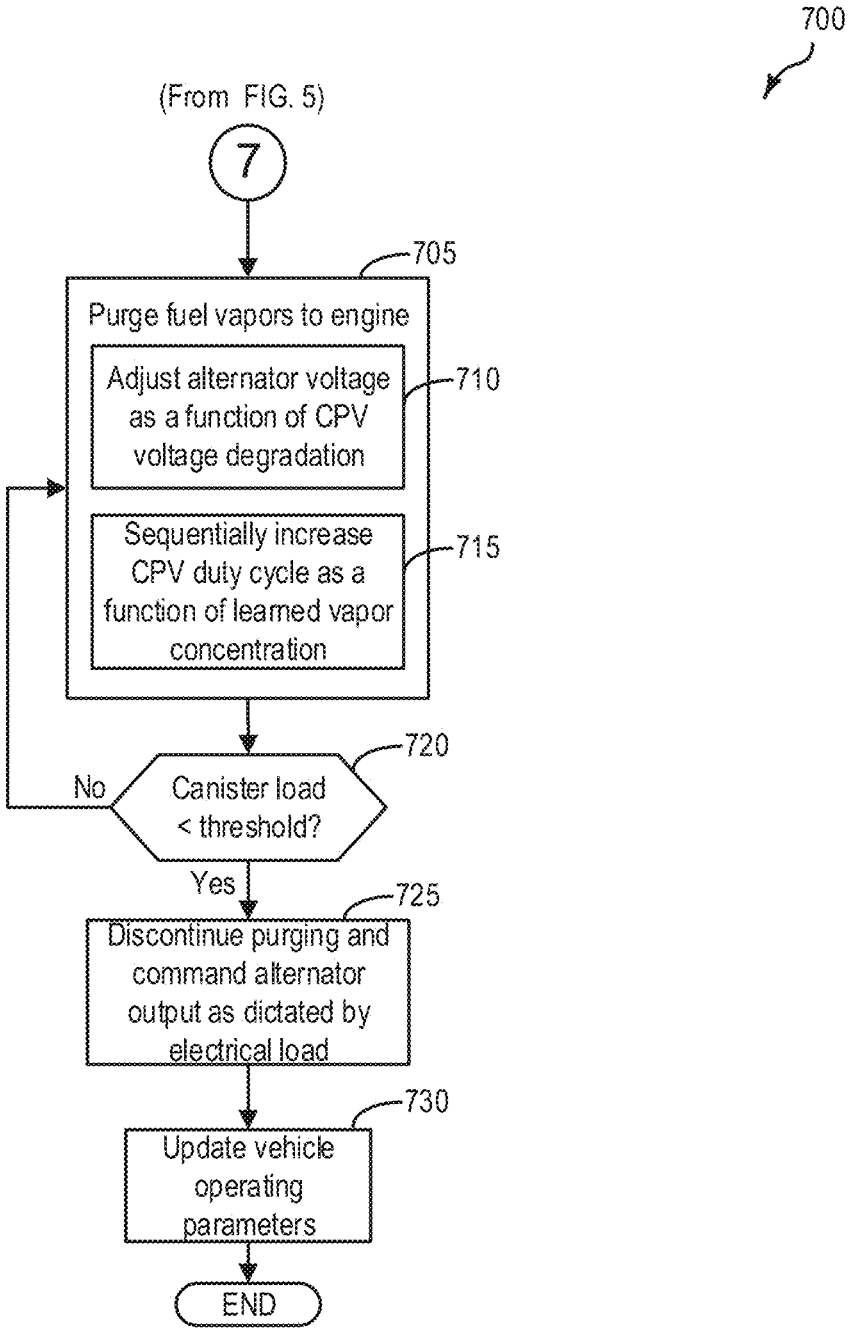
FIG. 7 depicts an example method for controlling a voltage supplied to a canister purge valve during a canister purging event where degraded voltage supply to the canister purge valve is inferred.

Returning to 525, in response to the indication that there is degraded voltage supply to the CPV (e.g. due to degradation of electrical connections that supply the CPV with electricity), method 500 proceeds to FIG. 7.

Turning now to FIG. 7, depicted is an example method 700 illustrating how to conduct a canister purging event under conditions where degraded voltage supply to the CPV is indicated. As method 700 continues from the method of FIG. 5, it may be understood that method 700 may be executed by the controller (e.g. controller 212 at FIG. 2), based on instructions stored in non-transitory memory, and in conjunction with signals received from sensors of the engine system, such as the sensors of FIGS. 1-2. The controller may employ actuators to alter states of devices in the physical world, as discussed above.

Method 700 begins at 705 and includes purging fuel vapors to the engine. The purging process may be substantially similar to that discussed above with regard to step 560 of method 500, with the exception that the alternator output voltage is controlled to a value that is a function of an extent to which the voltage supply to the CPV is degraded. For example, the alternator output voltage may be greater as the actual voltage drop determined via the method of FIG. 6 increases, and may be lesser as the actual voltage drop determined via the method of FIG. 6 decreases. However, in other examples, the amount by which the alternator output voltage is increased may be a predetermined amount, or the alternator output may be increased to a predetermined output level. In some examples, alternator output voltage may be ramped up over time during the purging process, similar to that discussed above with regard to FIG. 5.

Accordingly, at 710, method 700 includes adjusting the output voltage of the alternator such that a greater voltage is supplied to the CPV, which may thereby result in greater purge flow to counter the effect of the otherwise degraded voltage supply to the CPV. By raising the alternator output voltage, it may be understood that purge flow may be increased which may result in canister load decreasing by a faster rate than if the alternator output voltage were not raised, which may improve purging efficiency and reduce opportunity for release of undesired evaporative emissions to atmosphere.

Accordingly, at 715, method 700 includes sequentially increasing the CPV duty cycle as a function of a learned concentration of fuel vapors being inducted to the engine from the canister, similar to that discussed above. At 720, method 700 includes determining whether canister load is lower than the threshold canister load (e.g. loaded to less than 5% with fuel vapors). If not, then the purging operation may continue at step 705. Alternatively, in response to canister load being less than the threshold canister load, method 700 proceeds to 725 where the purging operation is discontinued. As discussed above, discontinuing of the purging event may include commanding closed the CPV. Furthermore, at step 725, method 700 includes commanding alternator output as dictated by electrical load. Specifically, similar to that discussed above, alternator output voltage may be decreased from its raised level back to that dictated by electrical load and not for purposes of increasing voltage directed to the CPV.

Proceeding to 730, method 700 includes updating vehicle operating parameters. Updating vehicle operating parameters may include updating the canister loading state to reflect the recent purging event. Updating vehicle operating parameters may additionally include updating a canister purge schedule based on the recent purging event. Battery SOC may be updated due to the increased alternator output voltage supplied via the alternator during the purging event. Battery temperature may in some examples additionally be updated. Method 700 may then end.

Thus, discussed herein, a method may comprise controlling a duty cycle of a canister purge valve to purge fuel vapors stored in a fuel vapor storage canister to an engine of a vehicle, and adjusting a flow rate at which the fuel vapors are purged to the engine independently of the duty cycle by controlling a magnitude of a voltage supplied to the canister purge valve during the purging.

For such a method, adjusting the flow rate may include increasing the flow rate by increasing the magnitude of the voltage supplied to the canister purge valve, and decreasing the flow rate by decreasing the magnitude of the voltage supplied to the canister purge valve.

For such a method, the method may further include adjusting the flow rate by adjusting an output voltage of a smart alternator.

For such a method, the method may further include adjusting the flow rate in response to an indication that there is a degraded voltage supply to the canister purge valve. The method may further include indicating that there is the degraded voltage supply to the canister purge valve based on a determination of a voltage drop across an electrical connection between an onboard energy storage device and the canister purge valve, in comparison to a baseline voltage drop across the connection between the onboard energy storage device and the canister purge valve.

For such a method, the fuel vapor storage canister may receive fuel vapors from a fuel tank of the vehicle. Such a method may further include adjusting the flow rate in response to an indication of a fuel tank pressure greater than a threshold fuel tank pressure during the purging.

For such a method, the method may further include monitoring an output from a hydrocarbon sensor positioned in a vent line stemming from the fuel vapor storage canister that couples the fuel vapor storage canister to atmosphere, and adjusting the flow rate in response to an indication that fuel vapors are entering into the vent line as indicated via the output from the hydrocarbon sensor immediately prior to or during the purging.

For such a method, the method may further include monitoring a canister temperature via a canister temperature sensor positioned within a threshold distance of a vent port of the fuel vapor storage canister, and adjusting the flow rate in response to an indication that the canister temperature is increasing near the vent port as indicated via the canister temperature sensor immediately prior to or during the purging.

For such a method, the method may further include learning a fuel vapor concentration being inducted to the engine from the fuel vapor storage canister during the purging, and sequentially ramping up the duty cycle of the canister purge valve during the purging as a function of the learned fuel vapor concentration.

Another example of a method may comprise increasing a magnitude of a voltage provided to a canister purge valve that is duty cycled in order to purge fuel vapors from a fuel vapor storage canister to an engine of a vehicle, in response to an indication that a voltage supply to the canister purge valve is degraded, where the magnitude of the voltage provided to the canister purge valve is a function of a determined amount to which the voltage supply to the canister purge valve is degraded.

For such a method, the method may further comprise comparing an actual voltage drop between an onboard energy source and the canister purge valve to a reference voltage drop to infer the determined amount to which the voltage supply to the canister purge valve is degraded, where the actual voltage drop is monitored via an analog voltage monitor line that communicably couples the canister purge valve to a controller of the vehicle.

For such a method, increasing the magnitude of the voltage provided to the canister purge valve may further include increasing an output voltage of a smart alternator. The method may further include reducing the output voltage of the smart alternator in response to an indication that a loading state of the fuel vapor storage canister is below a threshold loading state.

For such a method, the method may further comprise sequentially increasing a duty cycle of the canister purge valve to purge fuel vapors from the fuel vapor storage canister, where increasing the duty cycle of the canister purge valve is based on a learned concentration of fuel vapors that is being inducted into the engine while the canister is being purged. The method may further include maintaining increased the magnitude of the voltage provided to the canister without altering the magnitude of the voltage while the duty cycle of the canister purge valve is sequentially increasing and prior to an indication that conditions are no longer met for purging the fuel vapor storage canister.

Turning now to FIG. 8, depicted is a prophetic example timeline 800 illustrating how a canister purging operation may be conducted according to the method of FIG. 5. In other words, example timeline 800 depicts how a canister purging operation may be conducted when it is inferred that the fuel vaporization rate is greater than the first threshold fuel vaporization rate. Timeline 800 includes plot 805, indicating whether conditions are met for purging the canister (yes or no), over time. Timeline 800 further includes plot 810, indicating a status of the CPV (fully open or fully closed), over time. Timeline 800 further includes plot 815, indicating a status of the CVV (fully open or fully closed), over time. Timeline 800 further includes plot 820, indicating a fuel vaporization rate, over time. Fuel vaporization rate may increase (+) or decrease (−), over time. Timeline 800 further includes plot 825, indicating a canister loading state, over time. Canister loading state may increase (+) or decrease (−), over time. Timeline 800 further includes plot 830, indicating a smart alternator output voltage, over time. The output voltage may increase (+) or decrease (−), over time. Timeline 800 further includes plot 835, indicating a purge flow rate, over time. There may be no purge flow (0), or purge flow may increase (+) as compared to no flow.

At time t0, while not explicitly illustrated it may be understood that the vehicle is being propelled via engine operation. However, conditions are not yet met for purging the canister (plot 805). Thus, the CPV is closed (plot 810), and the CVV is open (plot 815). The fuel vaporization rate (plot 820) is above a first threshold fuel vaporization rate (refer to line 821). As discussed above, the fuel vaporization rate greater than the first threshold fuel vaporization rate may be inferred based on one or more of pressure as monitored via the FTPT (e.g. FTPT 291 at FIG. 2), output from a canister temperature sensor (e.g. temperature sensor 232 at FIG. 2) positioned near the vent line, and output from a hydrocarbon sensor (e.g. hydrocarbon sensor 264 at FIG. 2). Briefly, pressure in the fuel system greater than a threshold fuel system pressure may indicate that the fuel vaporization rate is greater than the first threshold fuel vaporization rate. It may be understood that the threshold fuel system pressure may be a non-zero positive pressure with respect to atmospheric pressure. In an additional or alternative example, a canister temperature sensor positioned near the vent line that is registering an increase in temperature may indicate that fuel vapors are escaping into the vent line, which may be used by the controller to infer that the fuel vaporization rate is greater than the first fuel vaporization rate threshold. In yet another additional or alternative example, the fuel vaporization rate may be inferred to be greater than the first threshold fuel vaporization rate in response to the actual presence of fuel vapors in the vent line, as monitored via the hydrocarbon sensor positioned in the vent line.

Furthermore, at time t0 the canister is loaded to some degree (plot 825), and alternator output voltage (plot 830) is a function of electrical load. In other words, at time t0 alternator output has not been commanded to an increased alternator output voltage, but is operating based on current electrical load. Because a canister purging event is not in progress, there is no purge flow at time t0 (plot 835).

At time t1, conditions are indicated to be met for purging the canister of stored fuel vapors (plot 805). In this example timeline 800 it may be understood that conditions are met because canister load is such that canister purging is requested, the engine is operating to combust air and fuel, and there is sufficient intake manifold vacuum (not shown) for executing a purging operation. However, as discussed, the fuel vaporization rate is greater than the first threshold fuel vaporization rate. Thus, if the canister were attempted to be purged with the current alternator output voltage settings, a rate at which the canister is loaded with fuel vapors stemming from the fuel tank may be greater than a rate at which the canister is purged of stored fuel vapors. Such a scenario may result in the canister being overwhelmed by fuel vapors, which may lead to release of undesired evaporative emissions if not accounted for.

Accordingly, at time t1 the CPV is commanded to an initial duty cycle (plot 810), and at the same time alternator output voltage is commanded via the controller to begin ramping up. Between time t1 and t2, the CPV duty cycle is maintained at the initial duty cycle, and alternator output voltage is continually ramped up. Because the CPV is receiving an increased voltage, purge flow rate (plot 835) is greater than if the CPV were not receiving the increased voltage (refer to representative dashed line 836 depicting purge flow in the absence of increased alternator output voltage).

While not explicitly illustrated, as discussed above during a canister purging operation the concentration of fuel vapors being inducted to the engine may be learned over time, and the learning of the fuel vapor concentration stemming from the canister may be used to correspondingly adjust the CPV duty cycle. Accordingly, at time t2 it may be understood that the controller of the vehicle determines that the CPV duty cycle may be increased, and thus between time t2 and t3 the CPV duty cycle is commanded to increase. The fuel vaporization rate remains above the second threshold fuel vaporization rate (represented by line 822), and thus alternator output voltage continues to ramp up (plot 835) under control of the controller. In some examples, a rate at which the alternator output voltage is ramped up may be a function of the learned fuel vapor concentration being inducted to the engine, so as to avoid a situation where engine hesitation and/or stall may occur. As can be seen at timeline 800, purge flow rate (plot 835) is greater than it otherwise would be (refer to dashed line 836) due to the increased alternator output voltage.

At time t3 the fuel vaporization rate drops below the second threshold fuel vaporization rate (refer to line 822). With the fuel vaporization rate having dropped below the second threshold fuel vaporization rate, it may be understood that the issue of fuel vapors loading the canister is under control so that canister purging may effectively take place. Said another way, when the fuel vaporization rate drops below the second threshold fuel vaporization rate it may be understood that the fuel tank is either within a threshold (e.g. within 5%) of atmospheric pressure and/or that there is a non-zero negative pressure with respect to atmospheric pressure in the fuel tank. Accordingly, there is no longer a need for increased purge flow, and maintaining the increased alternator output voltage may adversely impact fuel economy since the increased alternator output voltage is no longer advantageous in terms of the purging operation.

Thus, between time t2 and t3, alternator output voltage is commanded via the controller to an output voltage determined as a function of electrical load demand (plot 830). As can be seen at plot 830, alternator output voltage remained below an upper threshold output voltage (refer to line 831) and above a lower threshold output voltage (refer to line 832) during the time period (e.g. time t1-t4) that alternator output was commanded to be increased and then decreased under control of the controller. In other words, the increasing of the alternator output voltage was done in accordance with a predetermined tolerance range represented by the upper and lower thresholds (lines 831 and 832, respectively).

Based on the learned concentration of fuel vapors being inducted to the engine, CPV duty cycle is again increased at time t3. Accordingly, purge flow increases (plot 835). However, the increase in purge flow is not as great as it otherwise would be if the alternator output voltage was maintained at the increased level (refer to representative dashed line 837). As discussed, such increased purge flow is no longer desirable from a fuel economy standpoint because the fuel vaporization rate is below the second threshold fuel vaporization rate.

At time t4, the CPV duty cycle is further increased such that the CPV is fully open, or in other words is at a 100% duty cycle. Because the fuel vaporization rate is below the second threshold fuel vaporization rate, the vacuum applied to the canister via the engine is efficient in drawing fuel vapors from the canister into the engine for combustion. Accordingly, canister load decreases between time t4 and t5, and at time t5 canister load drops below the threshold canister load (e.g. 5% loaded or less) represented by line 826. With canister load below the threshold canister load, purging conditions are no longer indicated to be met (plot 805), and the CPV is commanded closed (plot 810). With the CPV commanded closed, purge flow rate drops to no flow (plot 835) after time t5.

Thus, the prophetic example timeline 800 discussed above illustrates how controlling alternator output voltage for a canister purging event can increase the purge flow independent of canister purge valve duty cycle (which may not be modifiable based on predetermined control strategy), which may be advantageous in reducing fuel vaporization rate to a level that allows the canister to be effectively purged when conditions are met for doing so.

Turning now to FIG. 9, depicted is a prophetic example timeline 900 illustrating how a canister purging operation may be conducted according to the method of FIGS. 5-7. In other words, example timeline 900 depicts how a canister purging operation may be conducted when it is inferred that voltage supply to the CPV is degraded. Timeline 900 includes plot 905, indicating whether conditions are met for purging the canister (yes or no), over time. Timeline 900 further includes plot 910, indicating a status of the CPV (fully open or fully closed), over time. Timeline 900 further includes plot 915, indicating a status of the CVV (fully open or fully closed), over time. Timeline 900 further includes plot 920, indicating a fuel vaporization rate, over time. Fuel vaporization rate may increase (+) or decrease (−), over time. Timeline 900 further includes plot 925, indicating a canister loading state, over time. Canister loading state may increase (+) or decrease (−), over time. Timeline 900 further includes plot 930, indicating smart alternator output voltage, over time. Alternator output may increase (+) or decrease (−), over time. Timeline 900 further includes plot 935, indicating purge flow rate, over time. There may be no purge flow (0), or purge flow may increase (+) as compared to no flow. Timeline 900 further includes plot 940, indicating whether there is degraded voltage supply to the CPV (yes or no), over time.

At time t0, while not explicitly illustrated, it may be understood that the vehicle is being propelled via engine operation, where the engine is combusting air and fuel. However, conditions are not yet met for purging the canister (plot 905), and accordingly the CPV is closed (plot 910). The CVV is open (plot 915), and the fuel vaporization rate (plot 920) is below the first and second threshold fuel vaporization rates (refer to plots 921 and 922, respectively). The canister is loaded to some degree (plot 925), and alternator output voltage (plot 930) is at a level driven by electrical demand. As a canister purging event is not in progress at time t0, there is no purge flow (plot 935). However, previous diagnostics (refer to the method of FIG. 6) have established that there is degraded voltage supply to the CPV (plot 940).

At time t1, conditions are indicated to be met for purging the canister (plot 905). Due to the issue of degraded voltage supply to the CPV, canister purging may not be effective if the voltage supply to the CPV is not raised. Accordingly, between time t1 and t2 the controller commands alternator output voltage to be raised (plot 930). The amount to which the alternator output voltage is raised is shown illustratively via line 931. It may be understood that the amount depicted by line 931 may be determined as a function of an extent to which the voltage supply is degraded, but which may also be dependent on other factors including but not limited to battery temperature, battery SOC, and engine operating conditions. In other words, while the amount to which the alternator output voltage is raised may be correlated with the extent of degradation of voltage supply, there may not be a 1:1 correlation where the alternator output voltage is increased by the exact same amount as the actual voltage drop measured between the battery and the CPV. However, in some examples the amount by which the alternator output voltage is increased may be the same (e.g. within 5% of) as the actual voltage drop corresponding to the CPV without departing from the scope of this disclosure. In this example timeline 900 it may be understood that alternator output voltage is increased to a predetermined level (represented by line 931) that is a function of the extent of degraded voltage supply to the CPV (in other words, related to the actual voltage drop), battery SOC and battery temperature.

Furthermore, at time t1, the CPV is commanded to an initial duty cycle. Thus, between time t1 and t2 the CPV is controlled according to the initial CPV duty cycle. Because the fuel vaporization rate is below the second threshold fuel vaporization rate, the purging process does not have to compete with the issue of fuel vapors loading the canister at a rate faster than a rate at which the vapors are purged from the canister, and accordingly canister load begins decreasing between time t1 and t2 (plot 925). Dashed line 927 depicts a representative example where alternator output voltage was not raised. In such an example, purge flow is lower (refer to dashed line 936) than purge flow with the alternator output voltage raised (plot 935), and thus canister load decreases at a slower rate (dashed line 927) than the actual rate at which the canister load decreases (plot 925) with the alternator output voltage raised.

As discussed above, while the canister is being purged the controller may learn the concentration of fuel vapors being inducted to the engine, in order to appropriately raise the CPV duty cycle in a manner so as to avoid issues pertaining to engine hesitation and/or stall. At time t2, it may be understood that the controller determines that the CPV duty cycle can be raised, and raises the CPV duty cycle accordingly (plot 910). With the duty cycle raised, purge flow rate increases (plot 935), and canister load continues to decrease (plot 925). The CPV duty cycle is again raised at time t3 and time t4 based on similar logic. As illustrated (refer to line 936), purge flow rate is lower when alternator output voltage is not raised, as compared to actual purge flow rate when alternator output voltage is raised (plot 935). Along similar lines, canister load decreases at a faster rate (see plot 925) when alternator output voltage is increased, as compared to a representative example when alternator output voltage is not raised (see plot 927).

At time t5, canister load drops below the threshold canister load (e.g. canister loaded to 5% or less), and thus conditions are no longer indicated to be met for canister purging (plot 905). Accordingly, the CPV is commanded closed (plot 910), and alternator output voltage is commanded to return to output voltage that is determined as a function of electrical load demand.

Thus, the prophetic example timeline 900 discussed above illustrates how controlling alternator output voltage for a canister purging event can increase purge flow rate under conditions where there is an indication of degraded voltage supply to the CPV. Increasing the purge flow rate in such a manner may serve to make canister purging events more efficient a standpoint of the timeframe it takes to purge the canister to below the threshold load. If the alternator output voltage were not raised under such conditions of degraded CPV voltage supply, canister purging events may not effectively clean the canister, which may increase opportunity for release of undesired evaporative emissions to atmosphere, reduce canister lifetime, and adversely impact fuel economy.

In this way, a smart alternator may be used to supply a canister purge valve with an increased voltage under conditions where it is desirable to increase a purge flow rate at which a fuel vapor canister is purged. By increasing purge flow rate, canister purging efficiency may be increased which may improve fuel economy, reduce opportunity for release of undesired evaporative emissions to atmosphere, and increase canister lifetime.

The technical effect of increasing alternator output voltage is to selectively increase purge flow rate in a manner that is independent of a canister purge valve duty cycle. For example, vehicle control strategy may not allow for changes to the manner in which canister purge valve duty cycle is controlled for a purging event, yet as discussed above it has herein been recognized that supplying an increased voltage to the canister purge valve solenoid may result in an increased purge flow rate that occurs regardless of current canister purge valve duty cycle. As discussed herein, there are certain conditions (e.g. fuel vaporization rate greater than a rate at which the canister is being purged, degraded voltage supply to the canister purge valve) where a canister purging operation may be sub-optimal. Thus, a technical effect of increasing the purge flow rate via increasing alternator output voltage is to enable efficient canister purging even under conditions of degraded voltage supply to the canister purge valve or when conditions are such that the canister cannot be effectively purged due to fuel vaporization issues.

The systems and methods discussed herein may enable one or more systems and one or more methods. In one example, a method comprises controlling a duty cycle of a canister purge valve to purge fuel vapors stored in a fuel vapor storage canister to an engine of a vehicle; and adjusting a flow rate at which the fuel vapors are purged to the engine independently of the duty cycle by controlling a magnitude of a voltage supplied to the canister purge valve during the purging. In a first example of the method, the method further includes wherein adjusting the flow rate includes increasing the flow rate by increasing the magnitude of the voltage supplied to the canister purge valve; and decreasing the flow rate by decreasing the magnitude of the voltage supplied to the canister purge valve. A second example of the method optionally includes the first example, and further comprises adjusting the flow rate by adjusting an output voltage of a smart alternator. A third example of the method optionally includes any one or more or each of the first through second examples, and further comprises adjusting the flow rate in response to an indication that there is a degraded voltage supply to the canister purge valve. A fourth example of the method optionally includes any one or more or each of the first through third examples, and further comprises indicating that there is the degraded voltage supply to the canister purge valve based on a determination of a voltage drop across an electrical connection between an onboard energy storage device and the canister purge valve, in comparison to a baseline voltage drop across the connection between the onboard energy storage device and the canister purge valve. A fifth example of the method optionally includes any one or more or each of the first through fourth examples, and further includes wherein the fuel vapor storage canister receives fuel vapors from a fuel tank of the vehicle and further comprising: adjusting the flow rate in response to an indication of a fuel tank pressure greater than a threshold fuel tank pressure during the purging. A sixth example of the method optionally includes any one or more or each of the first through fifth examples, and further comprises monitoring an output from a hydrocarbon sensor positioned in a vent line stemming from the fuel vapor storage canister that couples the fuel vapor storage canister to atmosphere; and adjusting the flow rate in response to an indication that fuel vapors are entering into the vent line as indicated via the output from the hydrocarbon sensor immediately prior to or during the purging. A seventh example of the method optionally includes any one or more or each of the first through sixth examples, and further comprises monitoring a canister temperature via a canister temperature sensor positioned within a threshold distance of a vent port of the fuel vapor storage canister; and adjusting the flow rate in response to an indication that the canister temperature is increasing near the vent port as indicated via the canister temperature sensor immediately prior to or during the purging. An eighth example of the method optionally includes any one or more or each of the first through seventh examples, and further comprises learning a fuel vapor concentration being inducted to the engine from the fuel vapor storage canister during the purging; and sequentially ramping up the duty cycle of the canister purge valve during the purging as a function of the learned fuel vapor concentration.

Another example of a method comprises increasing a magnitude of a voltage provided to a canister purge valve that is duty cycled in order to purge fuel vapors from a fuel vapor storage canister to an engine of a vehicle, in response to an indication that a voltage supply to the canister purge valve is degraded, where the magnitude of the voltage provided to the canister purge valve is a function of a determined amount to which the voltage supply to the canister purge valve is degraded. In a first example of the method, the method further comprises comparing an actual voltage drop between an onboard energy source and the canister purge valve to a reference voltage drop to infer the determined amount to which the voltage supply to the canister purge valve is degraded, where the actual voltage drop is monitored via an analog voltage monitor line that communicably couples the canister purge valve to a controller of the vehicle. A second example of the method optionally includes the first example, and further includes wherein increasing the magnitude of the voltage provided to the canister purge valve further comprises increasing an output voltage of a smart alternator. A third example of the method optionally includes any one or more or each of the first through second examples, and further comprises reducing the output voltage of the smart alternator in response to an indication that a loading state of the fuel vapor storage canister is below a threshold loading state. A fourth example of the method optionally includes any one or more or each of the first through third examples, and further comprises sequentially increasing a duty cycle of the canister purge valve to purge fuel vapors from the fuel vapor storage canister, where increasing the duty cycle of the canister purge valve is based on a learned concentration of fuel vapors that is being inducted into the engine while the canister is being purged; and maintaining increased the magnitude of the voltage provided to the canister without altering the magnitude of the voltage while the duty cycle of the canister purge valve is sequentially increasing and prior to an indication that conditions are no longer met for purging the fuel vapor storage canister.

An example of a system for a vehicle comprises a fuel vapor storage canister that receives fuel vapors from a fuel tank; a canister purge valve for purging fuel vapors stored at the fuel vapor storage canister to an engine; a smart alternator that charges an onboard energy storage device; and a controller with computer readable instructions stored on non-transitory memory that when executed, cause the controller to: raise an output voltage of the smart alternator during a canister purging event in response to an indication that fuel vaporization rate of fuel in the fuel tank is greater than a first threshold fuel vaporization rate during the canister purging event. In a first example of the system, the system further comprises a fuel tank pressure transducer; and wherein the controller stores further instructions to indicate that the fuel vaporization rate of fuel in the fuel tank is greater than the first threshold fuel vaporization rate under conditions where a fuel tank pressure as monitored via the fuel tank pressure transducer is greater than a non-zero positive pressure threshold with respect to atmospheric pressure during and/or immediately prior to the canister purging event. A second example of the system optionally includes the first example, and further comprises a hydrocarbon sensor positioned in a vent line that couples the fuel vapor storage canister to atmosphere; and wherein the controller stores further instructions to indicate that the fuel vaporization rate of fuel in the fuel tank is greater than the first threshold fuel vaporization rate in response to an indication that fuel vapors are migrating into the vent line as monitored via the hydrocarbon sensor, immediately prior to and/or during the canister purging event. A third example of the system optionally includes any one or more or each of the first through second examples, and further comprises a canister temperature sensor positioned in the fuel vapor storage canister within a threshold distance of a vent port of the fuel vapor storage canister; and wherein the controller stores further instructions to indicate that the fuel vaporization rate of fuel in the fuel tank is greater than the first threshold fuel vaporization rate in response to an increase in canister temperature as monitored via the canister temperature sensor immediately prior to and/or during the canister purging event. A fourth example of the system optionally includes any one or more or each of the first through third examples, and further includes wherein the controller stores further instructions to reduce the output voltage of the smart alternator during the canister purging event in response to an indication that the fuel vaporization rate has been reduced from being greater than the first threshold fuel vaporization rate to less than a second threshold fuel vaporization rate, where the second threshold fuel vaporization rate is equal to or less than the first threshold fuel vaporization rate. A fifth example of the system optionally includes any one or more or each of the first through fourth examples, and further comprises an exhaust gas oxygen sensor; wherein the controller stores further instructions to learn a concentration of fuel vapors being inducted to the engine during the canister purging event based at least in part on output from the exhaust gas oxygen sensor; and wherein the controller stores further instructions to sequentially increase a duty cycle of the canister purge valve as a function of the learned concentration of fuel vapors being inducted to the engine, where raising the output voltage of the smart alternator is in addition to sequentially increasing the duty cycle of the canister purge valve.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

during a first purge event, controlling a duty cycle of a canister purge valve to purge fuel vapors stored in a fuel vapor storage canister to an engine of a vehicle while supplying voltage to the canister purge valve at a default magnitude of voltage that is based on current vehicle operating parameters; and during a second purge event, controlling the duty cycle of the canister purge valve to purge fuel vapors stored in the fuel vapor storage canister to the engine, and adjusting a flow rate at which the fuel vapors are purged to the engine independently of the duty cycle by controlling the voltage supplied to the canister purge valve during the second purge event to an adjusted magnitude that is different than the default magnitude.

2. The method of claim 1, wherein adjusting the flow rate includes increasing the flow rate by increasing the magnitude of the voltage supplied to the canister purge valve relative to the default magnitude; and decreasing the flow rate by decreasing the magnitude of the voltage supplied to the canister purge valve relative to the default magnitude.

3. The method of claim 1, further comprising controlling the voltage supplied to the canister purge valve during the second purge event by adjusting an output voltage of a smart alternator.

4. The method of claim 1, further comprising, during both the first purge event and the second purge event, learning a fuel vapor concentration being inducted to the engine from the fuel vapor storage canister during the respective purge event; and wherein controlling the duty cycle during both the first purge event and the second purge event comprises sequentially ramping up the duty cycle of the canister purge valve during the respective purge event as a function of the learned fuel vapor concentration.

5. The method of claim 4, further comprising adjusting the flow rate in response to an indication that there is a degraded voltage supply to the canister purge valve.

6. The method of claim 5, further comprising indicating that there is the degraded voltage supply to the canister purge valve based on a determination of a voltage drop across an electrical connection between an onboard energy storage device and the canister purge valve, in comparison to a baseline voltage drop across the connection between the onboard energy storage device and the canister purge valve.

7. The method of claim 4, wherein the fuel vapor storage canister receives fuel vapors from a fuel tank of the vehicle and further comprising:

adjusting the flow rate in response to an indication of a fuel tank pressure greater than a threshold fuel tank pressure during the purging.

8. The method of claim 4, further comprising monitoring an output from a hydrocarbon sensor positioned in a vent line stemming from the fuel vapor storage canister that couples the fuel vapor storage canister to atmosphere; and adjusting the flow rate in response to an indication that fuel vapors are entering into the vent line as indicated via the output from the hydrocarbon sensor immediately prior to or during the purging.

9. The method of claim 4, further comprising monitoring a canister temperature via a canister temperature sensor positioned within a threshold distance of a vent port of the fuel vapor storage canister; and adjusting the flow rate in response to an indication that the canister temperature is increasing near the vent port as indicated via the canister temperature sensor immediately prior to or during the purging.

10. A system for a vehicle, comprising:

a fuel vapor storage canister that receives fuel vapors from a fuel tank;

a canister purge valve for purging fuel vapors stored at the fuel vapor storage canister to an engine;

a smart alternator that charges an onboard energy storage device; and a controller with computer readable instructions stored on non-transitory memory that when executed, cause the controller to:

raise an output voltage of the smart alternator during a canister purging event in response to an indication that a fuel vaporization rate of fuel in the fuel tank is greater than a first threshold fuel vaporization rate during the canister purging event.

11. The system of claim 10, further comprising:

a fuel tank pressure transducer; and wherein the controller stores further instructions to indicate that the fuel vaporization rate of fuel in the fuel tank is greater than the first threshold fuel vaporization rate under conditions where a fuel tank pressure as monitored via the fuel tank pressure transducer is greater than a non-zero positive pressure threshold with respect to atmospheric pressure during and/or immediately prior to the canister purging event.

12. The system of claim 10, further comprising:

a hydrocarbon sensor positioned in a vent line that couples the fuel vapor storage canister to atmosphere; and wherein the controller stores further instructions to indicate that the fuel vaporization rate of fuel in the fuel tank is greater than the first threshold fuel vaporization rate in response to an indication that fuel vapors are migrating into the vent line as monitored via the hydrocarbon sensor, immediately prior to and/or during the canister purging event.

13. The system of claim 10, further comprising:

a canister temperature sensor positioned in the fuel vapor storage canister within a threshold distance of a vent port of the fuel vapor storage canister; and wherein the controller stores further instructions to indicate that the fuel vaporization rate of fuel in the fuel tank is greater than the first threshold fuel vaporization rate in response to an increase in canister temperature as monitored via the canister temperature sensor immediately prior to and/or during the canister purging event.

14. The system of claim 10, wherein the controller stores further instructions to reduce the output voltage of the smart alternator during the canister purging event in response to an indication that the fuel vaporization rate has been reduced from being greater than the first threshold fuel vaporization rate to less than a second threshold fuel vaporization rate, where the second threshold fuel vaporization rate is equal to or less than the first threshold fuel vaporization rate.

15. The system of claim 10, further comprising:

an exhaust gas oxygen sensor;

wherein the controller stores further instructions to learn a concentration of fuel vapors being inducted to the engine during the canister purging event based at least in part on output from the exhaust gas oxygen sensor; and wherein the controller stores further instructions to sequentially increase a duty cycle of the canister purge valve as a function of the learned concentration of fuel vapors being inducted to the engine, where raising the output voltage of the smart alternator is in addition to sequentially increasing the duty cycle of the canister purge valve.

16. A method comprising:

determining that a voltage supply to a canister purge valve is degraded; and in response to the determination, increasing a magnitude of a voltage provided to the canister purge valve that is duty cycled in order to purge fuel vapors from a fuel vapor storage canister to an engine of a vehicle, where the magnitude of the voltage provided to the canister purge valve is a function of a determined amount of degradation of the voltage supply to the canister purge valve.

17. The method of claim 16, further comprising comparing an actual voltage drop between an onboard energy source and the canister purge valve to a reference voltage drop to infer the determined amount of degradation of the voltage supply to the canister purge valve, where the actual voltage drop is monitored via an analog voltage monitor line that communicably couples the canister purge valve to a controller of the vehicle.

18. The method of claim 16, wherein increasing the magnitude of the voltage provided to the canister purge valve further comprises increasing an output voltage of a smart alternator, and wherein determining that the voltage supply to the canister purge valve is degraded comprises determining that a voltage drop across an electrical connection between an onboard energy storage device and the canister purge valve is greater than a baseline voltage drop across the electrical connection.

19. The method of claim 18, further comprising reducing the output voltage of the smart alternator in response to an indication that a loading state of the fuel vapor storage canister is below a threshold loading state.

20. The method of claim 16, further comprising sequentially increasing a duty cycle of the canister purge valve to purge fuel vapors from the fuel vapor storage canister, where increasing the duty cycle of the canister purge valve is based on a learned concentration of fuel vapors that is being inducted into the engine while the canister is being purged; and maintaining the increased magnitude of the voltage provided to the canister purge valve without altering the magnitude of the voltage while the duty cycle of the canister purge valve is sequentially increasing and prior to an indication that conditions are no longer met for purging the fuel vapor storage canister.

* * * * *